US012049895B2

(12) United States Patent
Nagahara et al.

(10) Patent No.: US 12,049,895 B2
(45) Date of Patent: Jul. 30, 2024

(54) SCROLL COMPRESSOR AND REFRIGERATION CYCLE APPARATUS

(71) Applicant: DAIKIN INDUSTRIES, LTD., Osaka (JP)

(72) Inventors: Kenji Nagahara, Osaka (JP); Yoshitomo Tsuka, Osaka (JP); Nobuo Takahashi, Osaka (JP); Sayumi Nishikawa, Osaka (JP); Kosuke Araki, Osaka (JP); Tsuyoshi Fukunaga, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 18/427,373

(22) Filed: Jan. 30, 2024

(65) Prior Publication Data

US 2024/0167474 A1 May 23, 2024

Related U.S. Application Data

(63) Continuation of application No. PCT/JP2022/027430, filed on Jul. 12, 2022.

(30) Foreign Application Priority Data

Aug. 5, 2021 (JP) ..... 2021-129357

(51) Int. Cl.

| | |
|---|---|
| ***F04C 29/00*** | (2006.01) |
| ***F25B 31/02*** | (2006.01) |
| *F04C 18/02* | (2006.01) |

(52) U.S. Cl.

CPC ..... *F04C 29/00* (2013.01); *F25B 31/026* (2013.01); *F04C 18/0215* (2013.01); (Continued)

(58) Field of Classification Search

CPC ..... F04C 29/00; F04C 18/0215; F04C 2230/231; F04C 2240/30; F04C 2240/50; F04C 2240/60; F25B 31/026

See application file for complete search history.

(56) References Cited

FOREIGN PATENT DOCUMENTS

| | | | |
|---|---|---|---|
| EP | 3 339 644 A1 | | 6/2018 |
| JP | 11182433 A | * | 7/1999 |

(Continued)

OTHER PUBLICATIONS

International Preliminary Report of corresponding PCT Application No. PCT/JP2022/027430 dated Feb. 6, 2024.

(Continued)

*Primary Examiner* — Emmanuel E Duke

(74) *Attorney, Agent, or Firm* — Global IP Counselors, LLP

(57) ABSTRACT

A scroll compressor includes a crankshaft, a bearing rotatably supporting the crankshaft, a casing accommodating the crankshaft and the bearing, an arm supporting the bearing, a fixing portion connected to an end of the arm and fixed to the casing, and first and second pins. The first and second pins are press fitted into first and second holes and fixed to the casing by welding. The first hole is formed in the fixing portion and has a first center disposed at a position overlapping a minimum sectional area portion of the arm. The second hole is formed in the fixing portion and has a second center disposed at a position outside the minimum sectional area portion of the arm. A first force with which the first pin is held by the fixing portion is larger than a second force with which the second pin is held by the fixing portion.

16 Claims, 9 Drawing Sheets

(52) U.S. Cl.
CPC .... *F04C 2230/231* (2013.01); *F04C 2240/30* (2013.01); *F04C 2240/50* (2013.01); *F04C 2240/60* (2013.01)

(56) References Cited

FOREIGN PATENT DOCUMENTS

| | | | | | |
|---|---|---|---|---|---|
| JP | 2010236449 | A | * | 10/2010 | |
| JP | 2017-89426 | A | | 5/2017 | |
| JP | 2017089426 | A | * | 5/2017 | ..... F04C 23/008 |
| KR | 20140092213 | A | * | 7/2014 | ..... F04C 29/0021 |
| WO | WO-2018163233 | A1 | * | 9/2018 | ..... F04C 18/02 |

OTHER PUBLICATIONS

International Search Report of corresponding PCT Application No. PCT/JP2022/027430 dated Sep. 20, 2022.

* cited by examiner

SCROLL COMPRESSOR AND REFRIGERATION CYCLE APPARATUS

CROSS-REFERENCE TO RELATED APPLICATIONS

This is a continuation of International Application No. PCT/JP2022/027430 filed on Jul. 12, 2022, which claims priority to Japanese Patent Application No. 2021-129357, filed on Aug. 5, 2021. The entire disclosures of these applications are incorporated by reference herein.

BACKGROUND

Technical Field

The present disclosure relates to a scroll compressor and a refrigeration cycle apparatus.

Background Art

As disclosed in JP 2017-89426 A, a scroll compressor is known in which a fixing portion is provided at an end of an arm that supports a bearing, a plurality of welding pins is press-fitted into each of the fixing portion, and each of the welding pins and a casing are welded to fix the fixing portion and the casing.

SUMMARY

A scroll compressor according to a first aspect comprises a crankshaft, a bearing, a casing, an arm, a fixing portion, a first pin, and a second pin. The bearing rotatably supports the crankshaft. The casing accommodates the crankshaft and the bearing. The arm supports the bearing. The arm extends from the bearing toward the casing in a direction intersecting an axial direction of the crankshaft. The fixing portion is connected to an end of the arm. The fixing portion is fixed to the casing. The fixing portion is provided with a first hole and a second hole. When the first hole is viewed along a first direction, a center of the first hole is disposed at a position overlapping a minimum sectional area portion of the arm. When the second hole is viewed along a second direction, a center of the second hole is disposed at a position outside the minimum sectional area portion of the arm. The first direction is a direction orthogonal to the axial direction of the crankshaft heading from the first hole toward a center axis of the crankshaft. The second direction is a direction orthogonal to the axial direction of the crankshaft heading from the second hole toward the center axis of the crankshaft. The first pin is press-fitted into the first hole and fixed to the casing by welding. The second pin is press-fitted into the second hole and fixed to the casing by welding. A force with which the first pin is held by the fixing portion is larger than a force with which the second pin is held by the fixing portion.

DETAILED DESCRIPTION OF EMBODIMENT(S)

Embodiments

Figure 1:
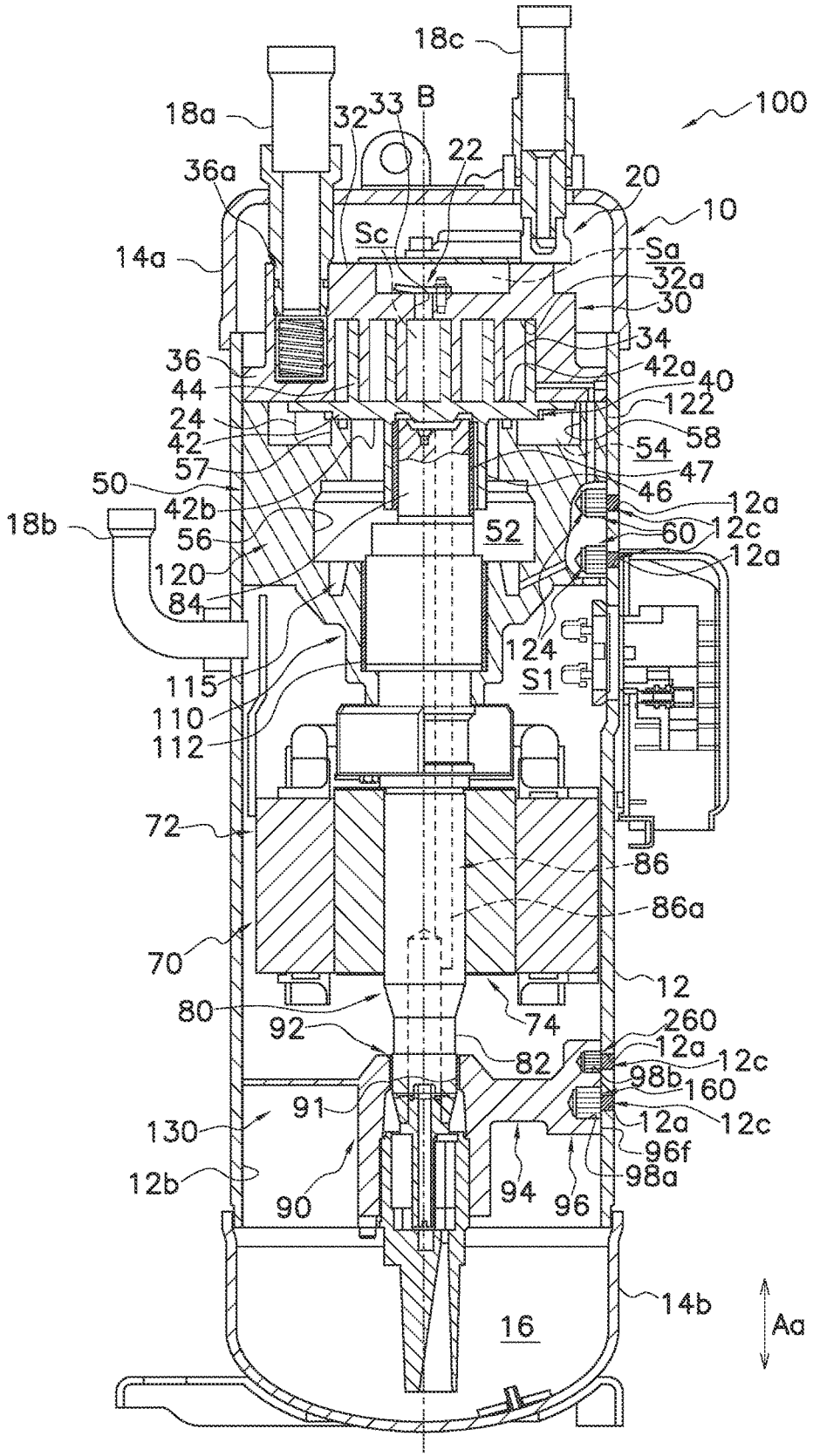
FIG. 1 is a schematic longitudinal sectional view of a scroll compressor according to a first embodiment.

Embodiments of a scroll compressor of the present disclosure will be described below with reference to the drawings.

The following description may include expressions such as "up" and "down" to describe positions and orientations. These expressions are used for convenience of description, and will not limit the present disclosure. Unless otherwise noted, the positions and the orientations represented by the expressions such as "up" and "down" follow arrows in the drawings.

In the following description, expressions such as "parallel", "orthogonal", "horizontal", "perpendicular", and "same" may be used, but these expressions do not necessarily mean parallel, orthogonal, horizontal, perpendicular, and same in a strict sense. The meanings of the expressions such as "parallel", "orthogonal", "horizontal", "perpendicular", and "same" include substantially parallel, orthogonal, horizontal, perpendicular, and same when these expressions are used.

A. Refrigeration Cycle Apparatus

A refrigeration cycle apparatus 1 including a scroll compressor 100 according to an embodiment of a refrigeration cycle apparatus including a scroll compressor of the present disclosure will be described with reference to FIG. 13.

The scroll compressor 100 is used in a refrigeration cycle apparatus 1 using a vapor compression refrigeration cycle such as an air conditioner, a hot water supply apparatus, and a floor heater. For example, the scroll compressor 100 is mounted in a heat source unit of the refrigeration cycle apparatus 1, and constitutes a part of a refrigerant circuit of the refrigeration cycle apparatus 1.

Figure 13:
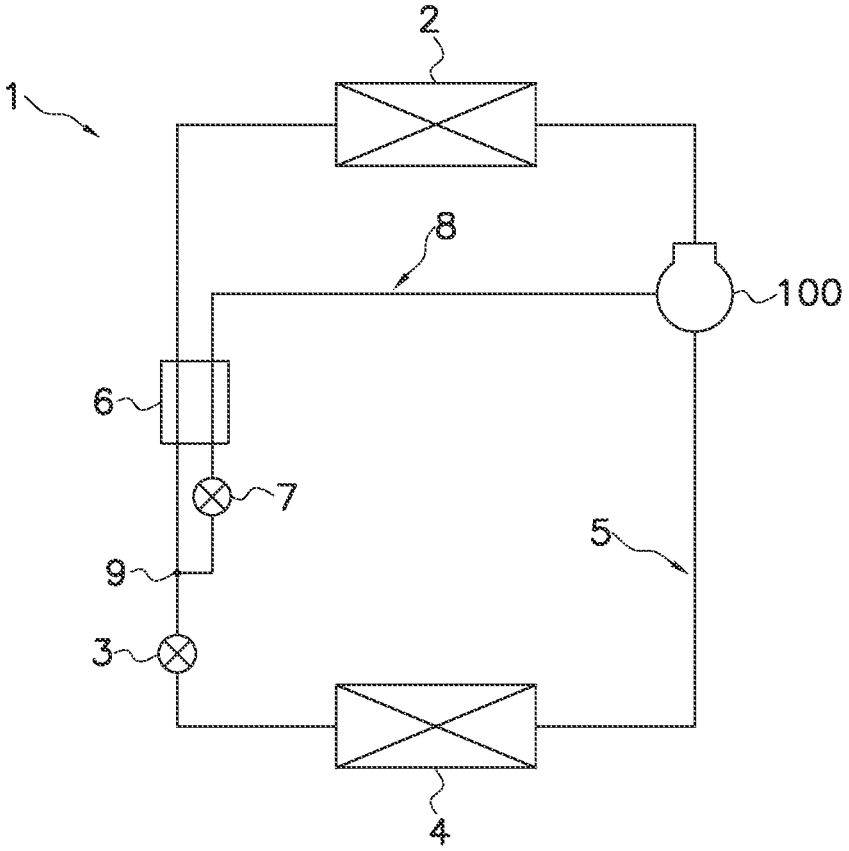
FIG. 13 is a schematic configuration diagram of an air conditioner according to an embodiment of a refrigeration cycle apparatus.

The refrigeration cycle apparatus 1 includes a refrigerant circuit 5 as shown in FIG. 13, for example. The refrigerant circuit 5 mainly includes the scroll compressor 100, a condenser (radiator) 2, an expansion device 3, and an evaporator 4. In the refrigerant circuit 5, the scroll compressor 100, the condenser 2, the expansion device 3, and the evaporator 4 are connected by pipes as shown in FIG. 13. The condenser 2 and the evaporator 4 are heat exchangers. The expansion device 3 may be, for example, an electric expansion valve whose opening degree is variable or a capillary tube.

As an optional configuration, in the present embodiment, the refrigerant circuit 5 includes a subcooling heat exchanger 6 and a bypass expansion device 7. The subcooling heat exchanger 6 is a heat exchanger in which a refrigerant flowing through a bypass pipe 8 and a refrigerant flowing through the refrigerant circuit 5 from the condenser 2 to the expansion device 3 exchange heat. The bypass pipe 8 is a pipe connecting a branch portion 9 on a pipe connecting the condenser 2 and the expansion device 3 in the refrigerant circuit 5, and an injection pipe 18*c* (described later) of the scroll compressor 100. The bypass expansion device 7 is, for example, an electric expansion valve whose opening degree is variable. The refrigerant flowing through the refrigerant circuit 5 from the condenser 2 to the expansion device 3 is cooled by heat exchange performed at the subcooling heat exchanger 6, becomes a refrigerant in a subcooled state, and flows to the expansion device 3. The refrigerant that has flowed through the bypass pipe 8, is decompressed to an intermediate pressure in a refrigeration cycle (pressure between high and low pressure in the refrigeration cycle, hereinafter sometimes simply referred to as an intermediate pressure) in the bypass expansion device 7, exchanges heat with the refrigerant flowing through the subcooling heat exchanger 6 from the condenser 2 to the expansion device 3, and is injected into a compression mechanism 20 (described below) of the scroll compressor 100.

In the refrigerant circuit 5, the scroll compressor 100 sucks a gas refrigerant having a low pressure in the refrigeration cycle (hereinafter sometimes simply referred to as a low pressure) and compresses the gas refrigerant in the compression mechanism 20. The gas refrigerant having a high pressure in the refrigeration cycle (hereinafter sometimes simply referred to as a high pressure) compressed in the compression mechanism 20 to be discharged from the scroll compressor 100 radiates heat and condenses in the condenser 2 to become a high-pressure liquid refrigerant. The refrigerant condensed in the condenser 2 flows to the expansion device 3. Part of the refrigerant flowing from the condenser 2 toward the expansion device 3 flows through the bypass pipe 8, is decompressed to the intermediate pressure by the bypass expansion device 7, cools the refrigerant flowing toward the expansion device 3 in the subcooling heat exchanger 6, and is then injected into the compression mechanism 20 of the compressor 100. The refrigerant that has passed through the subcooling heat exchanger 6 and flowed to the expansion device 3 is decompressed in the expansion device 3 and becomes a gas-liquid two-phase refrigerant having a low pressure in the refrigeration cycle (hereinafter sometimes simply referred to as a low pressure). The low-pressure gas-liquid two-phase refrigerant, having flowed through the subcooling heat exchanger 6 and decompressed in the expansion device 3, absorbs heat in the evaporator 4 and evaporates to become a low-pressure gas refrigerant. The low-pressure gas refrigerant that has exited the evaporator 4 is sucked into the scroll compressor 100 again and compressed.

For example, in a case where the refrigeration cycle apparatus 1 is an air conditioner, a heat exchanger mounted on a utilization unit functions as the evaporator 4, and a heat exchanger mounted on a heat source unit functions as the condenser 2 during cooling operation, whereas the heat exchanger mounted on the utilization unit functions as the condenser 2, and the heat exchanger mounted on the heat source unit functions as the evaporator 4 during heating operation. In a case where the refrigeration cycle apparatus 1 is an air conditioner and the air conditioner is used for both cooling and heating, the refrigeration cycle apparatus 1 further includes a flow path switching mechanism (not shown) such as a four-way switching valve to be used to switch between cooling operation and heating operation.

B. Scroll Compressor

First Embodiment (1) Overall Configuration

An outline of the scroll compressor 100 according to a first embodiment of a scroll compressor of the present disclosure will be described with reference to FIG. 1. FIG. 1 is a schematic longitudinal sectional view of the scroll compressor 100.

The scroll compressor 100 sucks a refrigerant having a low pressure in the refrigeration cycle (hereinafter sometimes simply referred to as low pressure), compresses the sucked refrigerant to a refrigerant having a high pressure in the refrigeration cycle (hereinafter sometimes simply referred to as high pressure), and discharges the compressed refrigerant. The refrigerant is, for example, a hydrofluorocarbon (HFC) refrigerant R32. Note that R32 is merely an example of the refrigerant, and, for example, the scroll compressor 100 may be a device that compresses an HFC refrigerant other than R32 or an HFO refrigerant. For example, the scroll compressor 100 may be a device that compresses and discharges a natural refrigerant such as carbon dioxide.

As shown in FIG. 1, the scroll compressor 100 mainly includes a casing 10, the compression mechanism 20, a housing 50, a motor 70, a crankshaft 80, a lower housing 130, and welding pins 60, 160, and 260.

(2) Detailed Configuration

The casing 10, the compression mechanism 20, the housing 50, the motor 70, the crankshaft 80, the lower housing 130, and the welding pins 60, 160, and 260 will be described in detail.

(2-1) Casing

The scroll compressor 100 includes the casing 10 having a longitudinally elongated cylindrical shape (see FIG. 1).

The casing 10 mainly includes a cylindrical member 12, an upper lid 14*a*, and a lower lid 14*b*. The cylindrical member 12 is a cylindrical member extending along a center axis B and has openings on upper and lower sides. The upper lid 14*a* is provided on an upper side of the cylindrical member 12 and closes the upper opening of the cylindrical member 12. The lower lid 14*b* is provided on a lower side of the cylindrical member 12 and closes the lower opening of the cylindrical member 12. The cylindrical member 12, the upper lid 14*a*, and the lower lid 14*b* are fixed by welding to maintain a hermetic state.

The casing 10 accommodates therein various members constituting the scroll compressor 100 including the compression mechanism 20, the housing 50, the motor 70, the crankshaft 80, and the lower housing 130 (see FIG. 1). The compression mechanism 20 is disposed in an upper part of the casing 10. The housing 50 is disposed below the compression mechanism 20. The motor 70 is disposed below the housing 50. The lower housing 130 is disposed below the motor 70. An oil reservoir space 16 is formed in a bottom of the casing 10. Refrigerator oil for lubricating various sliding portions of the scroll compressor 100 is stored in the oil reservoir space 16.

The motor 70 is disposed in a first space S1 of the scroll compressor 100. The first space S1 is a space below the housing 50 inside the casing 10. In the present embodiment, the first space S1 is a space into which a high-pressure refrigerant compressed by the compression mechanism 20 flows. In other words, the scroll compressor 100 according to the present embodiment is a so-called high-pressure dome-type scroll compressor. Note that the scroll compressor 100 is not required to be a high-pressure dome-type scroll compressor. For example, the scroll compressor 100 may be a so-called low-pressure dome-type scroll compressor in which a motor is disposed in a space into which a low-pressure refrigerant flows from the refrigerant circuit 5 of the refrigeration cycle apparatus 1.

A suction pipe 18*a*, a discharge pipe 18*b*, and the injection pipe 18*c* are attached to the casing 10 so that these pipes communicate an inside of the casing 10 with an outside of the casing 10 (see FIG. 1).

As shown in FIG. 1, the suction pipe 18*a* is provided to penetrate the upper lid 14*a* of the casing 10. One end (an end outside the casing 10) of the suction pipe 18*a* is connected to a pipe extending from the evaporator 4 of the refrigerant circuit 5 of the refrigeration cycle apparatus 1, and the other end (an end inside the casing 10) of the suction pipe 18*a* is connected to a suction port 36*a* of a fixed scroll 30 of the compression mechanism 20. The suction pipe 18*a* communicates with a compression chamber Sc described below on an outer peripheral side of the compression mechanism 20 via the suction port 36*a*. The scroll compressor 100 sucks a low-pressure refrigerant in the refrigeration cycle of the refrigeration cycle apparatus 1 via the suction pipe 18*a*.

As shown in FIG. 1, the discharge pipe 18*b* is provided at a center of the cylindrical member 12 in an up-down direction so as to penetrate the cylindrical member 12. One end (an end outside the casing 10) of the discharge pipe 18*b* is connected to a pipe extending to the condenser 2 of the refrigerant circuit 5 of the refrigeration cycle apparatus 1, and the other end (an end inside the casing 10) of the discharge pipe 18*b* is disposed between the housing 50 and the motor 70 in the first space S1. The scroll compressor 100 discharges a high-pressure refrigerant compressed by the compression mechanism 20 via the discharge pipe 18*b*.

As shown in FIG. 1, the injection pipe 18*c* is provided to penetrate the upper lid 14*a* of the casing 10. One end (an end outside the casing 10) of the injection pipe 18*c* is connected to the bypass pipe 8 of the refrigerant circuit 5 of the refrigeration cycle apparatus 1, and the other end (an end inside the casing 10) of the injection pipe 18*c* is connected to the fixed scroll 30 of the compression mechanism 20. The injection pipe 18*c* communicates with the compression chamber Sc being in a midstream of compression in the compression mechanism 20 via a passage (not shown) formed in the fixed scroll 30. A refrigerant having an intermediate pressure in the refrigeration cycle is supplied to the compression chamber Sc, with which the injection pipe 18*c* communicates and which is in the midstream of compression, from the refrigerant circuit 5 of the refrigeration cycle apparatus 1 via the injection pipe 18*c*. The intermediate pressure in the refrigeration cycle means an intermediate pressure between a low pressure and a high pressure in the refrigeration cycle. Hereinafter, instead of being described as the intermediate pressure in the refrigeration cycle, this pressure may be simply referred to as the intermediate pressure.

(2-2) Compression Mechanism

The compression mechanism 20 mainly includes the fixed scroll 30 and a movable scroll 40. The fixed scroll 30 and the movable scroll 40 are combined to form the compression chamber Sc. The compression mechanism 20 compresses a refrigerant in the compression chamber Sc and discharges the compressed refrigerant.

(2-2-1) Fixed Scroll

The fixed scroll 30 is mounted on the housing 50 and fixed to the housing 50 with a fixing means (for example, a bolt) (not shown).

As shown in FIG. 1, the fixed scroll 30 mainly includes a fixed-side end plate 32, a fixed-side wrap 34, and a peripheral edge 36.

The fixed-side end plate 32 is a circular plate-shaped member. The fixed-side wrap 34 is a wall-shaped member protruding toward the movable scroll 40 from a front surface 32*a* (lower surface) of the fixed-side end plate 32. When the fixed scroll 30 is viewed from below, the fixed-side wrap 34 is formed in a spiral shape (an involute shape) from a region near a center toward an outer periphery of the fixed-side end plate 32. The peripheral edge 36 is a thick cylindrical member protruding from the front surface 32*a* of the fixed-side end plate 32 toward the movable scroll 40. The peripheral edge 36 is disposed to surround a periphery of the fixed-side wrap 34. The peripheral edge 36 is provided with the suction port 36*a*. A lower end of the suction pipe 18*a* is connected to the suction port 36*a*.

The fixed-side wrap 34 of the fixed scroll 30 and a movable-side wrap 44 (described below) of the movable scroll 40 are combined to form the compression chamber Sc. Specifically, the fixed scroll 30 and the movable scroll 40 are combined in a state where the front surface 32*a* of the fixed-side end plate 32 and a front surface 42*a* (upper surface) of a movable-side end plate 42 described below are opposed to each other. As a result, the compression chamber Sc surrounded by the fixed-side end plate 32, the fixed-side wrap 34, the movable-side wrap 44, and the movable-side end plate 42 (described below) of the movable scroll 40 is formed (see FIG. 1). When the movable scroll 40 turns with respect to the fixed scroll 30, a low-pressure refrigerant flowing from the suction pipe 18*a* via the suction port 36*a* into the compression chamber Sc on a peripheral edge side is compressed as the refrigerant approaches the compression chamber Sc on a center side to cause a pressure of the refrigerant to be increased.

The fixed-side end plate 32 has at its approximately center a discharge port 33 through which the refrigerant compressed by the compression mechanism 20 is discharged. The discharge port 33 is formed to penetrate the fixed-side end plate 32 in a thickness direction (up-down direction)

(see FIG. 1). The discharge port 33 communicates with the compression chamber Sc on a center side (innermost side) of the compression mechanism 20. A discharge valve 22 that opens and closes the discharge port 33 is attached to an upper side of the fixed-side end plate 32. When a pressure in the compression chamber Sc on the innermost side, with which the discharge port 33 communicates, is equal to or higher than a pressure in a discharge space Sa above the discharge valve 22 by a predetermined value, the discharge valve 22 is opened to cause the refrigerant in the compression chamber Sc on the innermost side to pass through the discharge port 33 and flow into the discharge space Sa above the fixed-side end plate 32. The discharge space Sa communicates with a refrigerant passage (not shown) formed in the fixed scroll 30 and the housing 50. The refrigerant passage is a passage that causes the discharge space Sa and the first space S1 below the housing 50 to communicate with each other. The refrigerant compressed by the compression mechanism 20 and then flowing into the discharge space Sa passes through the refrigerant passage and flows into the first space S1.

(2-2-2) Movable Scroll

As shown in FIG. 1, the movable scroll 40 mainly includes the movable-side end plate 42, the movable-side wrap 44, and a boss 46.

The movable-side end plate 42 is a circular plate-shaped member. The movable-side wrap 44 is a wall-shaped member protruding toward the fixed scroll 30 from the front surface 42*a* (upper surface) of the movable-side end plate 42. When the movable scroll 40 is viewed from above, the movable-side wrap 44 is formed in a spiral shape (an involute shape) extending from a region near a center toward an outer periphery of the movable-side end plate 42. The boss 46 is a cylindrical member protruding from a back surface 42*b* (lower surface) of the movable-side end plate 42 toward the motor 70.

While the scroll compressor 100 is operating, the movable scroll 40 is pressed against the fixed scroll 30 by a pressure of a crank chamber 52 and a back pressure space 54, which will be described below, disposed on a side of the back surface 42*b* of the movable-side end plate 42. Since the movable scroll 40 is pressed against the fixed scroll 30, leakage of the refrigerant from a gap between a tip of the fixed-side wrap 34 and the movable-side end plate 42 and a gap between a tip of the movable-side wrap 44 and the fixed-side end plate 32 is suppressed.

The boss 46 is disposed in the crank chamber 52 (described below) formed by the housing 50. The boss 46 has a cylindrical shape. The boss 46 extends to protrude downward from the back surface 42*b* of the movable-side end plate 42. An upper portion of the cylindrical boss 46 is closed by the movable-side end plate 42. A bearing metal 47 is disposed in a hollow part of the boss 46. An eccentric portion 84 (described below) of the crankshaft 80 is inserted into the hollow part of the boss 46 (see FIG. 1). The crankshaft 80 is coupled to a rotor 74 of the motor 70 as described below. Therefore, when the motor 70 is operated and the rotor 74 rotates, the movable scroll 40 turns.

The movable scroll 40, which is turned by the motor 70, does not rotate by itself but moves in orbit with respect to the fixed scroll 30 by means of an Oldham coupling 24 (see FIG. 1) disposed on a side of the back surface 42*b* of the movable scroll 40.

When the movable scroll 40 moves in orbit with respect to the fixed scroll 30, the gas refrigerant in the compression chamber Sc of the compression mechanism 20 is compressed. Specifically, when the movable scroll 40 moves in orbit, the gas refrigerant is sucked from the suction pipe 18*a* via the suction port 36*a* into the compression chamber Sc on the peripheral edge side, and thereafter, the compression chamber Sc moves toward the center of the compression mechanism 20 (center of the fixed-side end plate 32). As the compression chamber Sc moves toward the center of the compression mechanism 20, a volume of the compression chamber Sc decreases and a pressure in the compression chamber Sc increases. As a result, the compression chamber Sc on the center side has a higher pressure than the compression chamber Sc on the peripheral edge side. The gas refrigerant compressed by the compression mechanism 20 to have a high pressure is discharged from the compression chamber Sc on the center side through the discharge port 33 formed in the fixed-side end plate 32 into the discharge space Sa. The refrigerant discharged into the discharge space Sa passes through the refrigerant passage (not shown) formed through the fixed scroll 30 and the housing 50, and flows into the first space S1 below the housing 50.

(2-3) Housing

The housing 50 supports the fixed scroll 30 and the movable scroll 40. The housing 50 supports a bearing metal 112 that pivotally supports the crankshaft 80.

As shown in FIG. 1, the housing 50 mainly includes a body 120 and an upper bearing housing 110. Although not limited thereto, the housing 50 is a cast product.

The body 120 is a cylindrical portion fixed to the casing 10. The upper bearing housing 110 also has a cylindrical shape. The upper bearing housing 110 is disposed closer to the motor 70 than the body 120 in an axial direction of the crankshaft 80.

The fixed scroll 30 is fixed to the body 120. Specifically, the fixed scroll 30 is mounted on the housing 50 in a state where a lower surface of the peripheral edge 36 of the fixed scroll 30 is opposed to an upper surface of the housing 50, and is fixed to the housing 50 by a fixing member (for example, a bolt) (not shown). The housing 50 supports the fixed scroll 30 fixed to the body 120.

The housing 50 also supports the movable scroll 40 disposed between the fixed scroll 30 and the body 120 of the housing 50. Specifically, the housing 50 supports the movable scroll 40 from below via the Oldham coupling 24 disposed on an upper side of the housing 50.

The body 120 is fixed to an inner peripheral surface 12*b* of the cylindrical member 12 of the casing 10. Specifically, the housing 50 is press-fitted into the cylindrical member 12 of the casing 10. All over the circumference, the outer peripheral surface 122 of the body 120 is at least partially in close contact with the inner peripheral surface 12*b* of the cylindrical member 12 in the axial direction of the crankshaft 80. The housing 50 is further fixed to the cylindrical member 12 of the casing 10 by welding.

The fixing of the housing 50 to the cylindrical member 12 by welding will be described.

Holes 124 into which the welding pins 60 are press-fitted are formed on the outer peripheral surface 122 of the cylindrical body 120. Each of the holes 124 extends along a radial direction of the cylindrical body 120. The holes 124 do not penetrate the body 120 in the radial direction of the body 120.

When viewed along the radial direction of the body 120, each of the holes 124 has a substantially the same shape as a cross section of the welding pin 60 obtained by cutting the welding pin 60 in a direction orthogonal to a press-fitting direction of the welding pin 60 (a direction in which the welding pin 60 is press-fitted into the hole 124). However, a maximum diameter of the welding pin 60 before press-fitting is larger than a diameter of the hole 124. An outer peripheral surface of the welding pin 60 is provided with irregularities, whereas the inner peripheral surface of the hole 124 is not provided with irregularities. The shape of the welding pin 60 will be described in detail later.

Although a number is not limited, the holes 124 are formed at a total of eight positions on the outer peripheral surface 122 of the housing 50. Although positions are not limited, on the outer peripheral surface 122 of the housing 50, the holes 124 are formed at two positions along the axial direction of the crankshaft 80 at each of four positions, at intervals of 90° in a circumferential direction.

In the cylindrical member 12 of the casing 10, through holes 12*a* as shown in FIG. 1 are formed at positions corresponding to the welding pins 60 of the housing 50 press-fitted into the cylindrical member 12 (positions corresponding to the holes 124 of the housing 50). At positions of the through holes 12*a*, the welding pins 60 press-fitted into the holes 124 and the cylindrical member 12 of the casing 10 are fixed by welding. In FIG. 1, welded portions are denoted by a reference sign 12*c*. As a result of the welding pins 60 press-fitted into the hole 124 of the body 120 of the housing 50 being welded and fixed to the cylindrical member 12, the housing 50 is fixed to the cylindrical member 12 of the casing 10 by welding as well.

The structure of the housing 50 will be further described.

As shown in FIG. 1, the body 120 includes a first recess 56 disposed to be recessed at a center and a second recess 58 disposed to surround the first recess 56. The first recess 56 constitutes a side surface of the crank chamber 52 in which the boss 46 of the movable scroll 40 is disposed. The second recess 58 forms the annular back pressure space 54 on the side of the back surface 42*b* of the movable-side end plate 42.

During steady operation of the scroll compressor 100 (in a state where operation of the scroll compressor 100 is stable), a pressure of the crank chamber 52 becomes a high pressure in the refrigeration cycle. As a result, during the steady operation of the scroll compressor 100, a center portion of the back surface 42*b* of the movable-side end plate 42 facing the crank chamber 52 is pushed toward the fixed scroll 30 at the high pressure.

When the movable scroll 40 turns during operation of the scroll compressor 100, the back pressure space 54 communicates with the compression chamber Sc in the midstream of compression via a hole (not shown) formed in the movable-side end plate 42 for a predetermined period in one turn of the movable scroll 40. Therefore, during the steady operation of the scroll compressor 100, the pressure in the back pressure space 54 becomes an intermediate pressure in the refrigeration cycle. As a result, during the steady operation of the scroll compressor 100, a peripheral edge of the back surface 42*b* of the movable-side end plate 42 facing the back pressure space 54 is pushed toward the fixed scroll 30 at the intermediate pressure.

The crank chamber 52 and the back pressure space 54 are separated from each other by an annular wall 57 disposed at a boundary between the first recess 56 and the second recess 58 (see FIG. 1). A seal ring (not shown) is disposed on an upper end of the wall 57 opposed to the back surface 42*b* of the movable-side end plate 42 so as to seal a space between the crank chamber 52 and the back pressure space 54.

The upper bearing housing 110 has a cylindrical shape. The bearing metal 112 that rotatably supports the crankshaft 80 is provided inside the cylindrical upper bearing housing 110. During the operation of the scroll compressor 100, a moment that causes the crankshaft 80 to fall may be applied to the crankshaft 80. An elastic groove 115 is formed in a connection portion between the upper bearing housing 110 and the body 120 so as to allow inclination of the upper bearing housing 110 when the moment is applied to the crankshaft 80.

(2-4) Motor

The motor 70 includes an annular stator 72 fixed to an inner wall surface of the cylindrical member 12 of the casing 10, and the rotor 74 disposed on an inner side of the stator 72 (see FIG. 1).

The rotor 74 is rotatably accommodated on the inner side of the stator 72 with a small gap (not shown) from the stator 72. The rotor 74 is coupled to the movable scroll 40 of the compression mechanism 20 via the crankshaft 80. Specifically, the rotor 74 is coupled to the boss 46 of the movable scroll 40 via the crankshaft 80 (see FIG. 1). The motor 70 turns the movable scroll 40 by rotating the rotor 74.

(2-5) Crankshaft

The crankshaft 80 couples the rotor 74 of the motor 70 to the movable scroll 40 of the compression mechanism 20. The crankshaft 80 extends along an axial direction Aa as in FIG. 1. In the scroll compressor 100 according to the present embodiment, the axial direction Aa is the up-down direction. The crankshaft 80 transmits a driving force of the motor 70 to the movable scroll 40 of the compression mechanism 20.

As shown in FIG. 1, the crankshaft 80 mainly includes a main shaft 82 and the eccentric portion 84.

The main shaft 82 extends in the up-down direction from the oil reservoir space 16 to the crank chamber 52. The main shaft 82 is rotatably supported by the bearing metal 112 of the upper bearing housing 110 and a bearing metal 91 of a lower bearing 90 described below. The main shaft 82 is inserted into and coupled to the rotor 74 of the motor 70 at a position between the upper bearing housing 110 of the housing 50 and the lower housing 130. A center axis C of the main shaft 82 preferably coincides with the center axis B of the cylindrical member 12 of the casing 10. Hereinafter, the center axis C of the main shaft 82 may be referred to as the center axis C of the crankshaft 80.

The eccentric portion 84 is disposed at an end (upper end in the present embodiment) of the main shaft 82. A center axis of the eccentric portion 84 is eccentric to the center axis C of the main shaft 82. The eccentric portion 84 is inserted into the boss 46 of the movable scroll 40 and is rotatably supported by the bearing metal 47 disposed inside the boss 46.

An oil passage 86 is formed inside the crankshaft 80. The oil passage 86 includes a main path 86*a* and a branch path (not shown). The main path 86*a* extends from a lower end to an upper end of the crankshaft 80 along the axial direction Aa of the crankshaft 80. The branch path branches off the main path and extends in a direction intersecting with the axial direction of the crankshaft 80. The refrigerator oil in the oil reservoir space 16 is pumped up by a pump (not shown) disposed at the lower end of the crankshaft 80, and is then supplied to, for example, sliding portions between the crankshaft 80 and the bearing metals 47, 112, and 91, and a sliding portion of the compression mechanism 20, via the oil passage 86.

(2-6) Lower Housing

Figure 2:
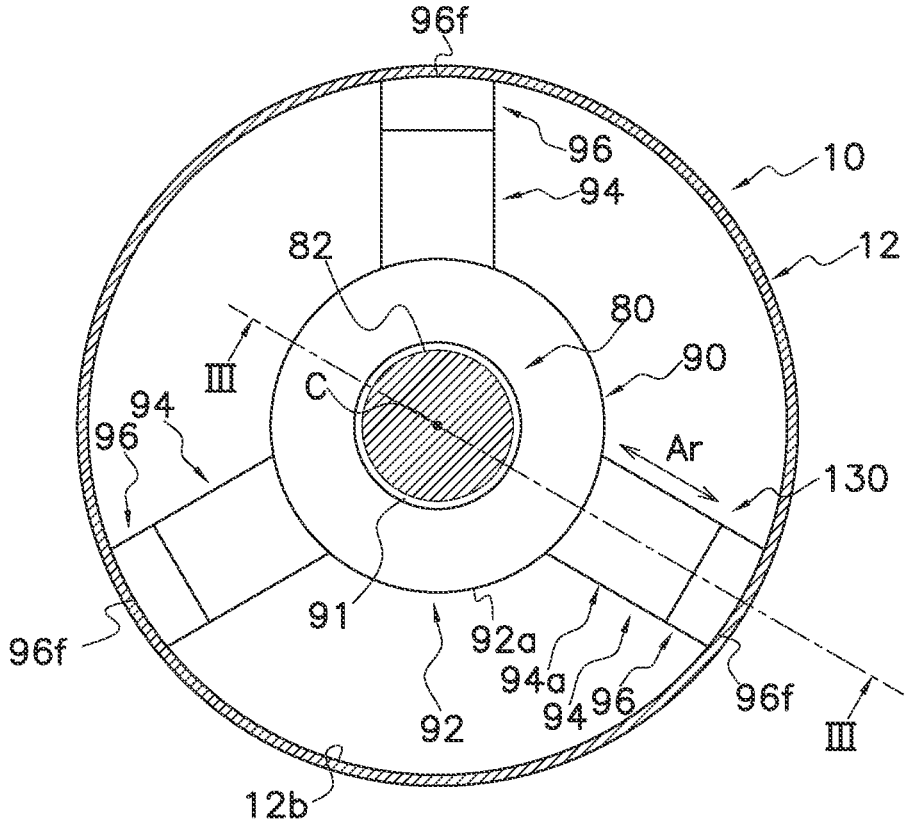
FIG. 2 is a diagram of a lower housing of the scroll compressor in FIG. 1 as viewed along an axial direction of a crankshaft.
Figure 3:
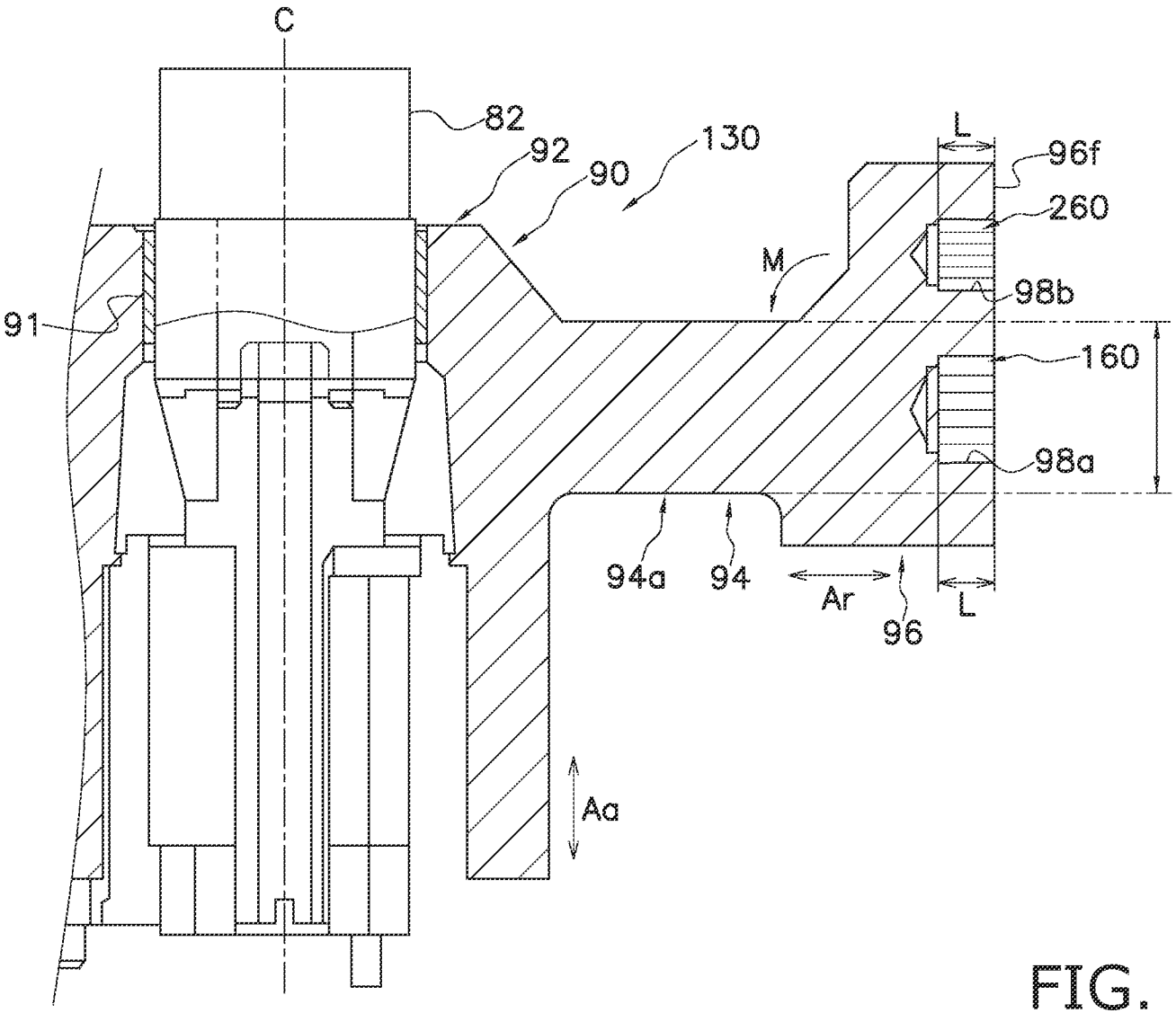
FIG. 3 is a schematic partial longitudinal sectional view of the lower housing taken along line in FIG. 2.
Figure 4:
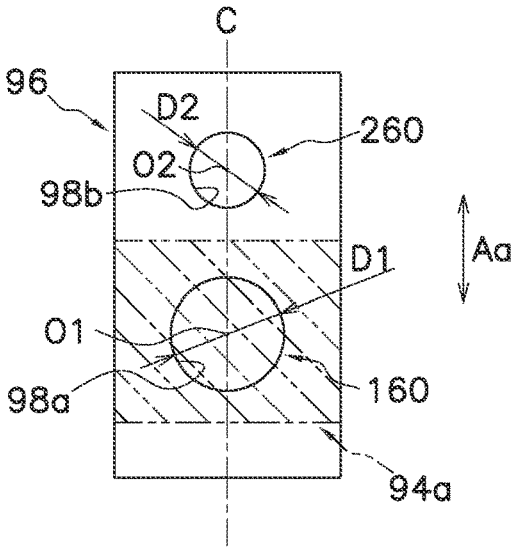
FIG. 4 is a side view of a first hole and a second hole formed in a fixing portion of the lower housing in FIG. 2 as viewed from an outer peripheral surface of the fixing portion toward a center axis of the crankshaft.

The lower housing 130 will be described with reference to FIGS. 2 to 4 in addition to FIG. 1. FIG. 2 is a diagram of the lower housing 130 as viewed along the axial direction Aa of the crankshaft 80. Specifically, FIG. 2 is a plan view of the lower housing 130 as viewed from above along the axial direction Aa of the crankshaft 80. FIG. 3 is a schematic partial longitudinal sectional view of the lower housing 130 taken along line III-III in FIG. 2. FIG. 4 is a side view of a first hole 98*a* and a second hole 98*b* formed in a fixing portion 96 of the lower housing 130 as viewed in a direction toward the center axis C of the crankshaft 80 from an outer peripheral surface 96*f* of the fixing portion 96.

As shown in FIGS. 1 to 3, the lower housing 130 mainly includes the lower bearing 90, an arm 94, and the fixing portion 96. The lower housing 130 is a structure for pivotally supporting the crankshaft 80. For example, the lower bearing 90 is a cast product, and the bearing housing 92, the arm 94, and the fixing portion 96 are integrally formed. However, the present disclosure is not limited to this configuration, and the bearing housing 92, the arm 94, and the fixing portion 96 may be separate members and integrally combined to function as the lower housing 130.

The lower bearing 90 rotatably supports the crankshaft 80. The lower bearing 90 includes the bearing metal 91 and the bearing housing 92. The bearing housing 92 has a cylindrical shape. The bearing metal 91 that rotatably supports the crankshaft 80 is accommodated inside the cylindrical bearing housing 92. The bearing housing 92 supports the bearing metal 91.

The arm 94 supports the lower bearing 90. The arm 94 is a rod-shaped member. The lower housing 130 includes the plurality of arms 94. Although the number of the arms 94 is not limited, the lower housing 130 has three arms 94. When the lower housing 130 is viewed along the axial direction Aa of the crankshaft 80, each of the arms 94 extends from the lower bearing 90 (specifically, from an outer peripheral surface 92*a* of the bearing housing 92) in a radial direction of the bearing housing 92 toward the casing 10. In other words, each arm 94 extends from the lower bearing 90 toward the casing 10 in a direction intersecting the axial direction Aa of the crankshaft 80. Specifically, when the lower housing 130 is viewed along the axial direction Aa of the crankshaft 80, each arm 94 extends on a straight line passing through a center (the center axis C) of the crankshaft 80 and along a radial direction of the crankshaft 80. Although a structure is not limited, on the outer peripheral surface 92*a* of the bearing housing 92, the three arms 94 are provided at substantially equal intervals (about 120° apart) in a circumferential direction of the crankshaft 80.

Each of the arms 94 is provided with one fixing portion 96. Therefore, the lower housing 130 has the same number of fixing portions 96 as the arms 94. An inner peripheral side of each fixing portion 96 is connected to an end (outer end) of the corresponding arm 94. The lower housing 130 is fixed to the casing 10 at the fixing portions 96. The outer peripheral surface 96*f* of the fixing portion 96 is preferably formed in an arc shape along the inner peripheral surface 12*b* of the cylindrical member 12 of the casing 10 when viewed along the axial direction Aa of the crankshaft 80 (see FIG. 2).

The fixing between the fixing portion 96 and the cylindrical member 12 of the casing 10 will be described.

The outer peripheral surface 96*f* of each fixing portion 96 is provided with the first hole 98*a* and the second hole 98*b*. Although not limited thereto, the first hole 98*a* and the second hole 98*b* are preferably circular holes. The first hole 98*a* and the second hole 98*b* extend in the radial direction Ar of the crankshaft 80 from the outer peripheral surface 96*f* of each fixing portion 96 toward the center axis C of the crankshaft 80.

The welding pin 160 is press-fitted into the first hole 98*a*. When the first hole 98*a* is viewed along the direction in which the first hole 98*a* extends (a press-fitting direction of the welding pin 160), the first hole 98*a* has substantially the same shape as a cross section obtained by cutting the welding pin 160 in a direction orthogonal to the press-fitting direction of the welding pin 160. However, a maximum diameter of the welding pin 160 before press-fitting is larger than a diameter of the first hole 98*a*. The outer peripheral surface of the welding pin 160 is provided with irregularities as described below, whereas the inner peripheral surface of the first hole 98*a* is not provided with irregularities. The shape of the welding pin 160 will be described in detail later.

The welding pin 260 is press-fitted into the second hole 98*b*. When the second hole 98*b* is viewed along the direction in which the second hole 98*b* extends (a press-fitting direction of the welding pin 260), the second hole 98*b* has substantially the same shape as a cross section of the welding pin 260 cut in a direction orthogonal to the press-fitting direction of the welding pin 260. However, a maximum diameter of the welding pin 260 before press-fitting is larger than a diameter of the second hole 98*b*. The outer peripheral surface of the welding pin 260 is provided with irregularities as described below, whereas the inner peripheral surface of the second hole 98*b* is not provided with irregularities. The shape of the welding pin 260 will be described in detail later.

The first hole 98*a* and the second hole 98*b* have similar shapes but have different dimensions. The difference in dimension between the first hole 98*a* and the second hole 98*b* will be described together in the description of the welding pins 160 and 260.

In the cylindrical member 12 of the casing 10, the through holes 12*a* as shown in FIG. 1 are formed at positions corresponding to the welding pins 160 and 260 of the fixing portion 96 of the lower housing 130 (in other words, positions corresponding to the first hole 98*a* and the second hole 98*b* of the lower housing 130). At positions of the through holes 12*a*, the welding pin 160 press-fitted into the first hole 98*a* and the welding pin 260 press-fitted into the second hole 98*b* and the cylindrical member 12 of the casing 10 are fixed by welding. In FIG. 1, a welded part is denoted by a reference sign 12*c*. As a result of the welding pins 160 and 260 press-fitted into the holes 98*a* and 98*b* of the fixing portion 96 of the lower housing 130 being welded and fixed to the cylindrical member 12, the lower housing 130 is fixed to the cylindrical member 12 of the casing 10.

Arrangement of First Hole and Second Hole

The arrangement of the first hole 98*a* and the second hole 98*b* in each fixing portion 96 will be described.

First, a minimum sectional area portion 94*a* of the arm 94 used to describe the arrangement of the first hole 98*a* and the second hole 98*b* will be described.

Each arm 94 has a minimum sectional area portion 94*a*. The minimum sectional area portion 94*a* is a portion having a minimum sectional area when the arm 94 is viewed along the radial direction Ar of the crankshaft 80 orthogonal to the axial direction Aa of the crankshaft 80 from the outer peripheral surface 96*f* of the fixing portion 96 coupled to the arm 94 toward the center axis C of the crankshaft 80. In other words, the minimum sectional area portion 94*a* is a portion having a minimum sectional area when the arm 94 is cut along a plane orthogonal to the radial direction Ar of the crankshaft 80, which is an extending direction of the arm 94. In the present embodiment, each arm 94 has the minimum sectional area portion 94*a* having a minimum sectional area when the arm 94 is cut along a vertical plane orthogonal to the radial direction Ar of the crankshaft 80, which is the extending direction of the arm 94. In FIG. 4, the minimum sectional area portion 94*a* is indicated by two-dot chain line hatching.

Note that the arm 94 may have the minimum sectional area portion 94*a* in a part of the arm 94. Alternatively, the sectional area of the arm 94 may be uniform, and the entire arm 94 may be the minimum sectional area portion 94*a*. In FIG. 4, the sectional shape of the minimum sectional area portion 94*a* is represented by a quadrangle, but alternatively, the sectional shape of the minimum sectional area portion 94*a* may be a shape other than a quadrangle.

The arrangement of the first hole 98*a* and the second hole 98*b* will be described.

When the first hole 98*a* is viewed along the radial direction Ar (first direction) of the crankshaft 80 orthogonal to the axial direction Aa of the crankshaft 80 toward the center axis C of the crankshaft 80, a center O1 of the first hole 98*a* is disposed at a position overlapping the minimum sectional area portion 94*a* of the arm 94. In other words, assuming a virtual straight line passing through the center O1 of the first hole 98*a* and the center axis C of the crankshaft 80 and extending in the radial direction Ar of the crankshaft 80 orthogonal to the axial direction Aa of the crankshaft 80, the virtual straight line passes through the minimum sectional area portion 94*a* of the arm 94.

When the first hole 98*a* is viewed along the radial direction Ar of the crankshaft 80 orthogonal to the axial direction Aa of the crankshaft 80 toward the center axis C of the crankshaft 80, the entire first hole 98*a* is preferably disposed at a position overlapping the minimum sectional area portion 94*a* of the arm 94 (see FIG. 4). In other words, assuming a virtual straight line passing through the center O1 of the first hole 98*a* and the center axis C of the crankshaft 80 and extending in the radial direction Ar of the crankshaft 80 orthogonal to the axial direction Aa of the crankshaft 80 and when the first hole 98*a* is projected on the minimum sectional area portion 94*a* of the arm 94 along the virtual straight line, the entire first hole 98*a* is preferably projected within the minimum sectional area portion 94*a*.

On the other hand, when the second hole 98*b* is viewed along the radial direction Ar (second direction) of the crankshaft 80 orthogonal to the axial direction Aa of the crankshaft 80 toward the center axis C of the crankshaft 80, a center O2 of the second hole 98*b* is disposed at a position outside the minimum sectional area portion 94*a* of the arm 94. In other words, when the second hole 98*b* is viewed along the radial direction Ar of the crankshaft 80 orthogonal to the axial direction Aa of the crankshaft 80 toward the center axis C of the crankshaft 80, the center O2 of the second hole 98*b* does not overlap the minimum sectional area portion 94*a* of the arm 94. Still in other words, assuming a virtual straight line passing through the center O2 of the second hole 98*b* and the center axis C of the crankshaft 80 and extending in the radial direction Ar of the crankshaft 80 orthogonal to the axial direction Aa of the crankshaft 80, the virtual straight line does not pass through the minimum sectional area portion 94*a* of the arm 94.

In the present embodiment, in each fixing portion 96, the first hole 98*a* and the second hole 98*b* are disposed at different positions in the axial direction Aa of the crankshaft 80. Specifically, as shown in FIGS. 3 and 4, in each fixing portion 96, the second hole 98*b* is disposed above the first hole 98*a*.

(2-7) Welding Pin

Figure 5:
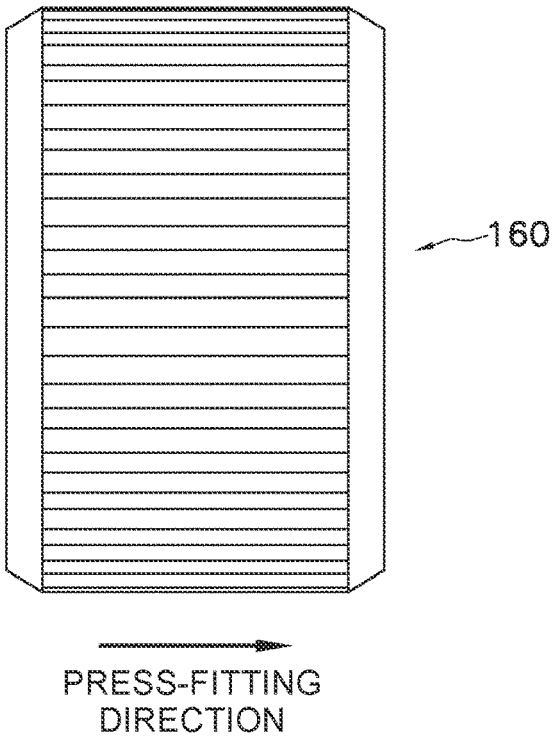
FIG. 5 is a diagram of a welding pin used in the scroll compressor in FIG. 1 before press-fitting, as viewed along a direction orthogonal to a press-fitting direction of the welding pin.
Figure 6:
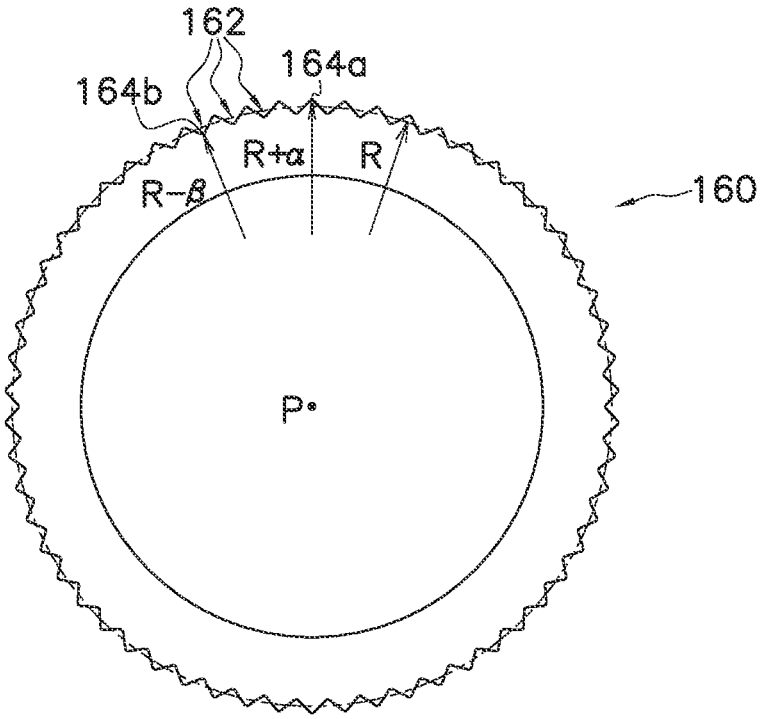
FIG. 6 is a diagram of the welding pin used in the scroll compressor in FIG. 1 before press-fitting, as viewed along the press-fitting direction of the welding pin.

The welding pins 60, 160, and 260 will be described with reference to FIGS. 5 to 6. FIG. 5 is a view of the welding pin 160 before press-fitting as viewed along a direction orthogonal to the press-fitting direction of the welding pin 160. FIG. 6 is a view of the welding pin 160 before press-fitting as viewed along the press-fitting direction of the welding pin 160. Note that the press-fitting direction of the welding pin 160 (hereinafter, simply sometimes referred to as a press-fitting direction) means a direction in which the welding pin 160 is press-fitted into the first hole 98*a*.

The welding pin 60 is press-fitted into the hole 124 of the body 120 of the housing 50 before the housing 50 is accommodated in the casing 10. Thereafter, the housing 50 is press-fitted into the cylindrical member 12 of the casing 10. Furthermore, the welding pin 60 press-fitted into the hole 124 of the body 120 of the housing 50 is fixed to the cylindrical member 12 of the casing 10 by welding.

The welding pin 160 is press-fitted into the first hole 98*a* of the fixing portion 96 of the lower housing 130 before the lower housing 130 is accommodated in the casing 10. The welding pin 260 is press-fitted into the second hole 98*b* of the fixing portion 96 of the lower housing 130 before the lower housing 130 is accommodated in the casing 10. Thereafter, the lower housing 130 is accommodated in the casing 10. Furthermore, the welding pins 160 and 260 press-fitted into the holes 98*a* and 98*b* of the fixing portion 96 are fixed to the cylindrical member 12 of the casing 10 by welding. In the present embodiment, the welding pin 160 is an example of a first pin, and the welding pin 260 is an example of a second pin.

The welding pins 60, 160, and 260 may be different in size but have similar shapes. Here, in order to avoid redundancy of similar drawings, only the welding pin 160 is illustrated as shown in FIGS. 5 and 6, and the illustration of the welding pins 60 and 260 is omitted. Here, among the welding pins 60, 160, and 260, the welding pin 160 will be described as a representative. Regarding the welding pins 60 and 260, differences of the welding pins 60 and 260 from the welding pin 160 will be mainly described.

The shape of the welding pin 160 will be described. Unless otherwise specified, the following description of the shape of the welding pin 160 describes the shape of the welding pin 160 before press-fitting into the first hole 98*a*.

As shown in FIGS. 5 and 6, the welding pin 160 is a substantially cylindrical member extending along the press-fitting direction of the welding pin 160. However, as shown in FIG. 6, a plurality of grooves 162 extending along an axial direction of the cylindrical welding pin 160 is provided on an outer peripheral surface of the welding pin 160. The plurality of grooves 162 are provided side by side in a circumferential direction. Therefore, when the welding pin 160 is viewed along the press-fitting direction, as shown in FIG. 6, recesses and protrusions are alternately arranged along the circumferential direction on the outer peripheral surface of the welding pin 160. The welding pins 60 and 260 also have a shape similar to the shape of the welding pin 160.

The size of the welding pin 160 as an example of the first pin, the size of the welding pin 260 as an example of the second pin, and the press-fitting of the welding pin 160 into the first hole 98*a* and the press-fitting of the welding pin 260 into the second hole 98*b* will be described.

The size of the welding pin 160 will be described. As viewed in the axial direction of the welding pin 160, a distance from the center P of the welding pin 160 to a vertex 164*a* of the protrusion is $R+\alpha$ ($\alpha>0$), and a distance from the center P of the welding pin 160 to a bottom 164*b* of the recess is $R-\beta$ ($\beta>0$) (see FIG. 6). When the diameter of the first hole 98*a* into which the welding pin 160 is press-fitted is denoted by D1, R=D1/2. A length of the welding pin 160 in the axial direction (length in the press-fitting direction) is L.

The size of the welding pin 260 will be described. As viewed in the axial direction of the welding pin 260, a distance from a center of the welding pin 260 to the vertex of the protrusion is R'+γ (γ>0), and a distance from the center P of the welding pin 260 to the bottom of the recess is R'−δ (δ>0). When the diameter of the second hole 98*b* into which the welding pin 260 is press-fitted is denoted by D2, R'=D2/2. In the present embodiment, α=γ and β=δ. A length of the welding pin 260 in the axial direction (length in the press-fitting direction) is L, which is the same as the length of the welding pin 160 in the axial direction.

Press-fitting of the welding pin 160 into the first hole 98*a* will be described.

The welding pin 160 is fixed to the fixing portion 96 of the lower housing 130 by being press-fitted into the first hole 98*a*. As described above, the distance from the center P of the welding pin 160 to the vertex 164*a* of the protrusion is R+α (α>0) is larger than a radius D1/2 (=R) of the first hole 98*a*. However, when the welding pin 160 is press-fitted into the first hole 98*a*, the protrusion of the welding pin 160 (the protrusion disposed between the adjacent grooves 162) causes elastic deformation or partial plastic deformation, and as a result, the welding pin 160 is accommodated in the first hole 98*a* having the diameter D1. The welding pin 160 press-fitted into the first hole 98*a* is pressed in a radial direction of the first hole 98*a* with an elastic force, and is held by the fixing portion 96. Hereinafter, the diameter D1 of the first hole 98*a* into which the welding pin 160 is press-fitted is referred to as a diameter of the welding pin 160 when the welding pin 160 is viewed along the press-fitting direction. In practice, the first hole 98*a* may also be deformed by press-fitting of the welding pin 160 and become larger than the original diameter D1, but the deformation of the first hole 98*a* is ignored here.

Here, a holding force with which the welding pin 160 is held by the fixing portion 96 is referred to as a holding force F1. The holding force F1 with which the welding pin 160 is held by the fixing portion 96 means a magnitude of a maximum force with which the welding pin 160 does not move in a direction opposite to the press-fitting direction when a force in the direction opposite to the press-fitting direction of the welding pin 160 is applied to the welding pin 160 press-fitted into the fixing portion 96. In other words, the holding force F1 with which the welding pin 160 is held by the fixing portion 96 means a force required to pull out the welding pin 160 from the first hole 98*a*.

Since the press-fitting of the welding pin 260 into the second hole 98*b* and the force by which the fixing portion 96 holds the welding pin 260 are similar to the press-fitting of the welding pin 160 into the first hole 98*a* and the force by which the fixing portion 96 holds the welding pin 160, the description thereof is omitted. Hereinafter, as in the case of the welding pin 160, the diameter D2 of the second hole 98*b* into which the welding pin 260 is press-fitted is referred to as a diameter of the welding pin 260 when the welding pin 260 is viewed along the press-fitting direction. In addition, a holding force with which the welding pin 260 is held by the fixing portion 96 is referred to as a holding force F2.

In the scroll compressor 100 of the present disclosure, the holding force F1 with which welding pin 160 is held by the fixing portion 96 is larger than the holding force F2 with which the welding pin 260 is held by the fixing portion 96. The reason why the holding force F1 is made larger than the holding force F2 will be described.

As described above, the first hole 98*a* and the second hole 98*b* extend in the radial direction Ar of the crankshaft 80 from the outer peripheral surface 96*f* of each fixing portion 96 toward the center axis C of the crankshaft 80. As described above, when the first hole 98*a* is viewed along the radial direction Ar of the crankshaft 80 orthogonal to the axial direction Aa of the crankshaft 80 and heading toward the center axis C of the crankshaft 80, the center O1 of the first hole 98*a* is disposed at a position overlapping the minimum sectional area portion 94*a* of the arm 94. On the other hand, when the second hole 98*b* is viewed along the radial direction Ar of the crankshaft 80 orthogonal to the axial direction Aa of the crankshaft 80 heading toward the center axis C of the crankshaft 80, the center O2 of the second hole 98*b* is disposed at a position outside the minimum sectional area portion 94*a* of the arm 94.

Therefore, assuming that a press-fitting load of the welding pin 260 into the second hole 98*b* is the same as a press-fitting load of the welding pin 160 into the first hole 98*a*, when the welding pin 260 is press-fitted into the second hole 98*b*, a larger moment (moment indicated by an arrow M in FIG. 3) is applied to the minimum sectional area portion 94*a* of the arm 94 than when the welding pin 160 is press-fitted into the first hole 98*a*.

However, here, since the holding force F2 with which the welding pin 260 is held by the fixing portion 96 is smaller than the holding force F1 with which the welding pin 160 is held by the fixing portion 96, the press-fitting load at the time of press-fitting of the welding pin 260 is also smaller than the press-fitting load at the time of press-fitting of the welding pin 160. Therefore, even when the plurality of welding pins 160 and 260 is press-fitted into the fixing portion 96 in order to support a large force applied to the lower bearing 90 (even when each fixing portion 96 is welded at two or more portions), it is possible to suppress the occurrence of a failure in which the arm 94 is damaged by the moment applied by the press-fitting load.

When the holding force with which the welding pin is held by the fixing portion is small, the press-fitting load at the time of press-fitting the welding pin into the hole of the fixing portion is also small for the following reason.

As described above, the holding force with which the welding pin is held by the fixing portion is rephrased for a force required to pull out the welding pin from the hole of the fixing portion. Both the force for press-fitting the welding pin into the hole and the force for pulling out the welding pin from the hole are expressed by a similar formula: a friction coefficient×surface pressure at which the hole of the fixing portion pushes the welding pin×contact area between the hole and the welding pin (=diameter of welding pin×π× length of welding pin) (however, in general, the value of the friction coefficient at the time of press-fitting and the value of the friction coefficient at the time of pulling out are different). As described above, since the holding force and the press-fitting load are calculated by using a similar formula, there is a positive correlation between the holding force with which the welding pin is held by the fixing portion and the press-fitting load at the time of press-fitting of the welding pin.

As a method of suppressing application of a large moment to the minimum sectional area portion 94*a* of the arm 94 when the welding pin 260 is press-fitted into the second hole 98*b*, a method other than making the holding force F1 larger than the holding force F2 is also conceivable.

For example, when the second hole 98*b* is viewed along the radial direction Ar of the crankshaft 80 orthogonal to the axial direction Aa of the crankshaft 80 heading toward the center axis C of the crankshaft 80, if the first hole 98*a* and the second hole 98*b* are brought close to each other such that the center O2 of the second hole 98*b* is disposed at a position overlapping the minimum sectional area portion 94*a* of the arm 94, the moment applied to the minimum sectional area portion 94*a* of the arm 94 when the welding pin 260 is press-fitted into the second hole 98*b* decreases. However, when the first hole 98*a* and the second hole 98*b* are brought close to each other, a heat-affected portion of the casing 10 caused by the welding with the welding pin 160 and a heat-affected portion of the casing 10 caused by the welding with the welding pin 260 come close to each other, which may adversely affect a strength of the casing 10.

In addition, for example, by increasing the sectional area of the minimum sectional area portion 94*a* of the arm 94, it is possible to avoid the approach of the heat affected part of the casing 10 caused by the welding with the welding pin 160 and the heat affected part of the casing 10 caused by the welding with the welding pin 260 while disposing the center O2 of the second hole 98*b* at a position overlapping the minimum sectional area portion 94*a* of the arm 94 when the second hole 98*b* is viewed along the radial direction Ar of the crankshaft 80 heading toward the center axis C of the crankshaft 80. However, such a configuration causes another problem that the arm 94 increases in size and the scroll compressor 100 also increases in size.

In contrast to these methods, when the holding force F2 with which the welding pin 260 is held by the fixing portion 96 is made smaller than the holding force F1 with which the welding pin 160 is held by the fixing portion 96 as in the present embodiment, it is possible to suppress the occurrence of a failure in which the arm 94 is damaged by a moment applied by the press-fitting load of the welding pin 260 while suppressing a decrease in strength of the casing 10 and an increase in size of the scroll compressor 100.

A specific configuration for making holding force F1 with which welding pin 160 is held by fixing portion 96 larger than holding force F2 with which welding pin 260 is held by fixing portion 96 will be described.

In the present embodiment, the diameter D1 of the welding pin 160 when the welding pin 160 is viewed along the press-fitting direction is larger than the diameter D2 of the welding pin 260 when the welding pin 260 is viewed along the press-fitting direction. The diameter D1 of the welding pin 160 when the welding pin 160 is viewed along the press-fitting direction is preferably 1.5 times or more and 2.5 times or less the diameter D1 of the welding pin 260 when the welding pin 260 is viewed along the press-fitting direction. As a result, since the contact area of the welding pin 160 with the fixing portion 96 is larger than the contact area of the welding pin 260 with the fixing portion 96, the holding force F1 with which the welding pin 160 is held by the fixing portion 96 can be made larger than the holding force F2 with which the welding pin 260 is held by the fixing portion 96.

Although numerical values are not limited, for example, the diameter D1 of the welding pin 160 is 16 mm and is twice the diameter D2 of the welding pin 260=8 mm Although numerical values are not limited, the length L of the welding pin 160 and the welding pin 260 is, for example, 8 mm A depth of the first hole 98*a* into which the welding pin 160 is press-fitted (a depth of the first hole 98*a* in the press-fitting direction of the welding pin 160) and a depth of the second hole 98*b* into which the welding pin 260 is press-fitted (a depth of the second hole 98*b* in the press-fitting direction of the welding pin 260) are substantially the same as the lengths L of the welding pin 160 and the welding pin 260.

The size of the welding pin 60 may be appropriately selected independently of the welding pins 160 and 260. For example, the size of the welding pin 60 may be the same as the size of the welding pin 160, may be the same as the size of the welding pin 260, or may be different from the sizes of the welding pins 160 and 260. Here, details of the size of the welding pin 60 and press-fitting of the welding pin 60 into the hole 124 will not be described.

(3) Operation of Scroll Compressor

Operation of the scroll compressor 100 will be described.

When the motor 70 is driven, the rotor 74 rotates, and the crankshaft 80 coupled to the rotor 74 also rotates. When the crankshaft 80 rotates, the movable scroll 40 does not rotate, but revolves with respect to the fixed scroll 30, by the action of the Oldham coupling 24. The low-pressure refrigerant in the refrigeration cycle of the refrigeration cycle apparatus 1 flowing from the suction pipe 18*a* is sucked into the compression chamber Sc on the peripheral edge side of the compression mechanism 20 via the suction port 36*a*. As the volume of the compression chamber Sc decreases along with orbital motion of the movable scroll 40, the pressure in the compression chamber Sc increases. The refrigerant having an intermediate pressure (pressure between high pressure and low pressure) in the refrigeration cycle of the refrigeration cycle apparatus 1 is appropriately injected into the compression chamber Sc in the midstream of compression from the injection pipe 18*c*. The pressure of the refrigerant increases as the refrigerant approaches the compression chamber Sc on the center side (inner side) from the compression chamber Sc on the peripheral edge side (outer side) and finally becomes a high pressure in the refrigeration cycle of the refrigeration cycle apparatus 1. The refrigerant compressed by the compression mechanism 20 is discharged from the discharge port 33 located near a center of the fixed-side end plate 32, passes through a refrigerant path (not shown) formed through the fixed scroll 30 and the housing 50, and flows into the first space S1. The high-pressure refrigerant in the refrigeration cycle is discharged from the first space S1 through the discharge pipe 18*b*.

(4) Characteristics (4-1)

The scroll compressor 100 according to the present embodiment includes the crankshaft 80, the lower bearing 90 as an example of a bearing, the casing 10, the arm 94, the fixing portion 96, the welding pin 160 as an example of a first pin, and the welding pin 260 as an example of a second pin. The lower bearing 90 rotatably supports the crankshaft 80. The casing 10 accommodates the crankshaft 80 and the lower bearing 90. The arm 94 supports the lower bearing 90. The arm 94 extends from the lower bearing 90 toward the casing 10 in a direction intersecting the axial direction Aa of the crankshaft 80. The fixing portion 96 is connected to an end of the arm 94. The fixing portion 96 is fixed to the casing 10. The fixing portion 96 is provided with the first hole 98*a* and the second hole 98*b*. When the first hole 98*a* is viewed along the first direction (radial direction Ar), the center O1 of the first hole 98*a* is disposed at a position overlapping the minimum sectional area portion 94*a* of the arm 94. When the second hole 98*b* is viewed along the second direction (radial direction Ar), the center O2 of the second hole 98*b* is disposed at a position outside the minimum sectional area portion 94*a* of the arm 94. The first direction is a direction orthogonal to the axial direction Aa of the crankshaft 80 and heading from the first hole 98*a* (specifically, from the center O1 of the first hole 98*a*) toward the center axis C of the crankshaft 80. The second direction is a direction orthogonal to the axial direction Aa of the crankshaft 80 and heading from the second hole 98*b* (specifically, from the center O2 of the second hole 98*b*) toward the center axis C of the crankshaft 80. The welding pin 160 is press-fitted into the first hole 98*a* and is fixed to the casing 10 by welding. The welding pin 260 is press-fitted into the second hole 98*b* and is fixed to the casing 10 by welding. The holding force F1 with which the welding pin 160 is held by the fixing portion 96 is larger than the holding force F2 with which the welding pin 260 is held by the fixing portion 96.

When the welding pin 260 is press-fitted into the second hole 98*b* of the fixing portion 96, a relatively large moment is likely to be applied to the arm 94. However, since the force with which the welding pin 260 (second pin) is held by the fixing portion 96 is smaller than the force with which the welding pin 160 (first pin) is held by the fixing portion 96 in this scroll compressor 100, the press-fitting load at the time of press-fitting of the welding pin 260 is smaller than the press-fitting load at the time of press-fitting of the welding pin 160 for the reasons described above. Therefore, even when a plurality of pins is press-fitted into the fixing portion 96 in order to support a large force applied to the lower bearing 90, it is possible to suppress occurrence of a failure in which the arm 94 is damaged by a moment applied by the press-fitting load.

(4-2)

In the scroll compressor 100 according to the present embodiment, the first hole 98*a* and the second hole 98*b* are disposed at different positions in the axial direction Aa of the crankshaft 80.

Therefore, in the scroll compressor 100, the lower bearing 90 that receives a force of the crankshaft 80 in the radial direction can be stably supported by the casing 10.

(4-3)

In the scroll compressor 100 according to present embodiment, the diameter D1 of the welding pin 160 (first pin) when the welding pin 160 is viewed along the press-fitting direction is larger than the diameter D2 of the welding pin 260 (second pin) when the welding pin 260 is viewed along the press-fitting direction.

Accordingly, in the scroll compressor 100, the welding pin 160 can support a larger force.

(4-4)

In the scroll compressor 100 according to the present embodiment, the diameter D1 of the welding pin 160 when the welding pin 160 is viewed along the press-fitting direction is 1.5 times or more and 2.5 times or less the diameter D2 of the welding pin 260 when the welding pin 260 is viewed along the press-fitting direction.

In the scroll compressor 100 according to the present embodiment, the lower bearing 90 can be firmly supported by the casing 10, and occurrence of damage of the arm 94 when the welding pin 260 is press-fitted into the fixing portion 96 can be suppressed.

(4-5)

The refrigeration cycle apparatus 1 includes the refrigerant circuit 5 including the scroll compressor 100, the condenser 2, the evaporator 4, and the expansion device 3.

Second Embodiment

Figure 7:
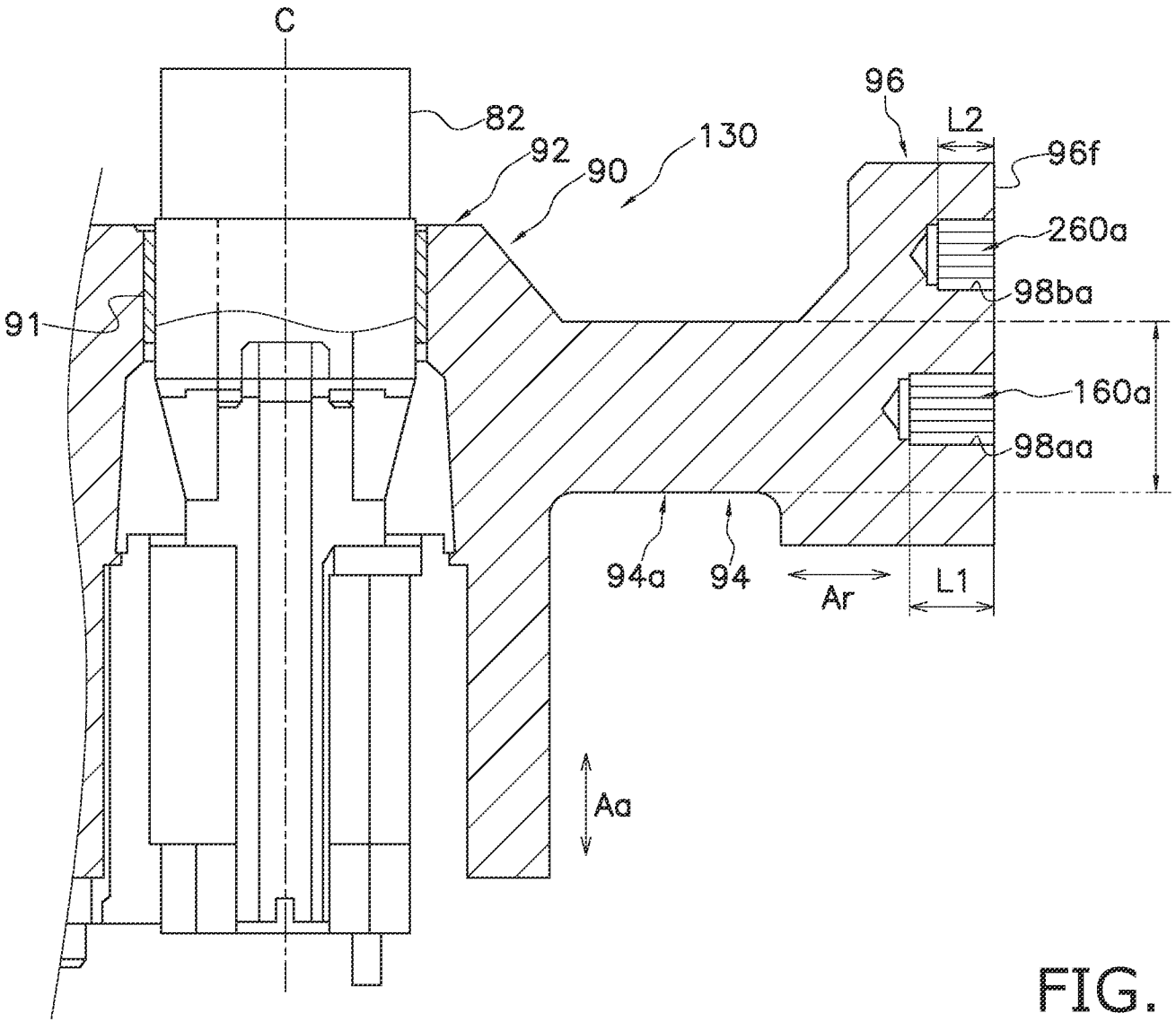
FIG. 7 is a schematic partial longitudinal sectional view of a lower housing of a scroll compressor according to a second embodiment.
Figure 8:
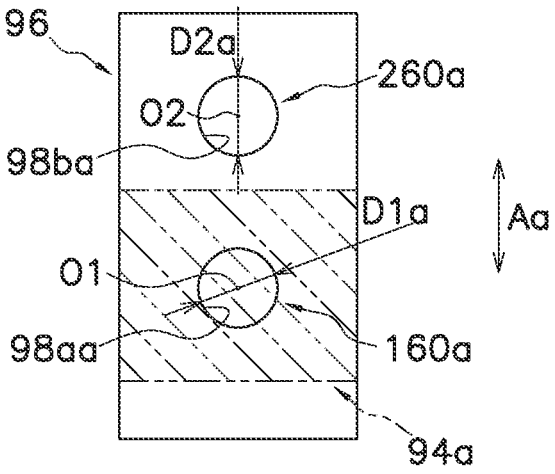
FIG. 8 is a side view of a first hole and a second hole formed in a fixing portion of the lower housing in FIG. 7 as viewed from an outer peripheral surface of the fixing portion toward a center axis of the crankshaft.

A scroll compressor 100 according to a second embodiment will be described with reference to FIGS. 7 and 8. FIG. 7 is a schematic partial longitudinal sectional view of a lower housing 130 of the scroll compressor 100 according to the second embodiment. FIG. 8 is a side view of a first hole 98*a* and a second hole 98*b* formed in a fixing portion 96 of the lower housing 130 as viewed in a direction toward a center axis C of a crankshaft 80 from an outer peripheral surface 96*f* of the fixing portion 96.

The scroll compressor 100 according to the second embodiment is similar to the scroll compressor 100 according to the first embodiment except for the shapes of a welding pin 160*a* and a welding pin 260*a* respectively corresponding to the welding pin 160 and the welding pin 260 in the first embodiment, and the shapes of a first hole 98*aa* and a second hole 98*ba* respectively corresponding to the first hole 98*a* and the second hole 98*b* in the first embodiment. Here, the shapes of the welding pin 160*a* and the welding pin 260*a* and the shapes of the first hole 98*aa* and the second hole 98*ba*, which are differences from the first embodiment, will be mainly described, and the description of common points with the first embodiment will be omitted unless necessary.

In the second embodiment, as in the first embodiment, when the first hole 98*aa* is viewed along the first direction, the center O1 of the first hole 98*aa* is disposed at a position overlapping the minimum sectional area portion 94*a* of the arm 94. When the second hole 98*ba* is viewed along the second direction, the center O2 of the second hole 98*ba* is disposed at a position outside the minimum sectional area portion 94*a* of the arm 94. The first direction is the radial direction Ar of the crankshaft 80 orthogonal to the axial direction Aa of the crankshaft 80 from the first hole 98*aa* toward the center axis C of the crankshaft 80. The second direction is the radial direction Ar of the crankshaft 80 orthogonal to the axial direction Aa of the crankshaft 80 from the second hole 98*ba* toward the center axis C of the crankshaft 80.

The size of the welding pin 160*a* which is an example of a first pin, the size of the welding pin 260*a* which is an example of a second pin, and the sizes of the first hole 98*aa* into which the welding pin 160*a* is press-fitted and the second hole 98*ba* into which the welding pin 260*a* is press-fitted will be described. Since the shapes of the welding pin 160*a* and the welding pin 260*a* are similar to the shapes of the welding pin 160 according to the first embodiment shown in FIGS. 5 and 6, the drawings of the welding pin 160*a* and the welding pin 260*a* are omitted.

The size of the welding pin 160*a* will be described. As viewed in the axial direction of the welding pin 160*a*, a distance from the center of the welding pin 160*a* to a vertex 164*a* of the protrusion is $R1+\alpha1$ ($\alpha1>0$), and a distance from the center of the welding pin 160*a* to a bottom 164*b* of the recess is $R1-\beta1$ ($\beta1>0$). When the diameter of the first hole 98*aa* into which the welding pin 160*a* is press-fitted is denoted by D1*a*, R1=D1*a*/2. Hereinafter, the diameter D1*a* of the first hole 98*aa* into which the welding pin 160*a* is press-fitted is referred to as a diameter of the welding pin 160*a* when the welding pin 160*a* is viewed along the press-fitting direction. The length of the welding pin 160 in the axial direction (length in the press-fitting direction) is L1.

The size of the welding pin 260*a* will be described. As viewed in the axial direction of the welding pin 260*a*, a distance from a center of the welding pin 260*a* to the vertex of the protrusion is $R1'+\gamma1$ ($\gamma1>0$), and a distance from the center of the welding pin 260*a* to the bottom of the recess is $R1'-\delta1$ ($\delta1>0$). When the diameter of the second hole 98*b* into which the welding pin 260*a* is press-fitted is denoted by D2*a*, R1'=D2*a*/2. Hereinafter, the diameter D2*a* of the second hole 98*ba* into which the welding pin 260*a* is press-fitted is referred to as a diameter of the welding pin 260*a* when the welding pin 260*a* is viewed along the press-fitting direction. In the present embodiment, $\alpha1=\gamma1$ and $\beta1=\delta1$. In the present embodiment, the diameter D1*a* of the first hole 98*a* is the same as the diameter D2*a* of the second hole 98*b*, and R1=R1'. In other words, in the second embodiment, the diameter of the welding pin 160*a* when the welding pin 160*a* is viewed along the press-fitting direction is equal to the diameter of the welding pin 260*a* when the welding pin 260*a* is viewed along the press-fitting direction. A length of the welding pin 260*a* in the axial direction (length in the press-fitting direction) is L2 and is shorter than the length L1 of the welding pin 160*a* in the axial direction (L1<L2).

In the second embodiment, although the diameter of the welding pin 160*a* is equal to the diameter of the welding pin 260*a* as viewed in the press-fitting direction, the length L1 of the welding pin 160*a* in the axial direction is longer than the length L2 of the welding pin 260*a* in the axial direction. As a result, the contact area of welding pin 160*a* with the first hole 98*aa* becomes larger than the contact area of the welding pin 260*a* with the second hole 98*ba*. Thus, the holding force F1 with which the welding pin 160*a* is held by a fixing portion 96*a* becomes larger than the holding force F2 with which the welding pin 260*a* is held by the fixing portion 96. The reason why the holding force F1 is made larger than the holding force F2 and the effect obtained by making the holding force F1 larger than the holding force F2 are similar to those in the first embodiment, and thus will not be described here.

The length L1 of the welding pin 160*a* in the press-fitting direction is preferably 1.5 times or more and 2.5 times or less the length L2 of the welding pin 260*a* in the press-fitting direction. Although numerical values are not limited, for example, the length L1 of the welding pin 160*a* is 16 mm and is twice the length L2 of the welding pin 260*a*=8 mm A depth of the first hole 98*aa* into which the welding pin 160*a* is press-fitted (a depth of the first hole 98*aa* in the press-fitting direction of the welding pin 160*a*) is substantially the same as the length L1 of the welding pin 160*a*. A depth of the second hole 98*ba* into which the welding pin 260*a* is press-fitted (a depth of the second hole 98*ba* in the press-fitting direction of the welding pin 260*a*) is substantially the same as the length L2 of the welding pin 260*a*.

Although numerical values are not limited, the diameter D1*a* of the first hole 98*aa* and the diameter D2*a* of the second hole 98*ba* are, for example, 8 mm (5) Modifications The configuration of the first embodiment and the configuration of the second embodiment may be appropriately combined within a range not contradictory to each other.

Modifications of the above embodiments will be described below. The following modifications may appropriately be combined insofar as there are no inconsistencies.

(5-1) Modification A

In the first embodiment, when the first hole 98*a* is viewed along the radial direction Ar of the crankshaft 80 orthogonal to the axial direction Aa of the crankshaft 80 toward the center axis C of the crankshaft 80, the entire first hole 98*a* is disposed at a position overlapping the minimum sectional area portion 94*a* of the arm 94. Further, in the first embodiment, when the second hole 98*b* is viewed along the radial direction Ar of the crankshaft 80 orthogonal to the axial direction Aa of the crankshaft 80 toward the center axis C of the crankshaft 80, the entire second hole 98*b* is disposed at a position outside the minimum sectional area portion 94*a* of the arm 94.

Figure 9:
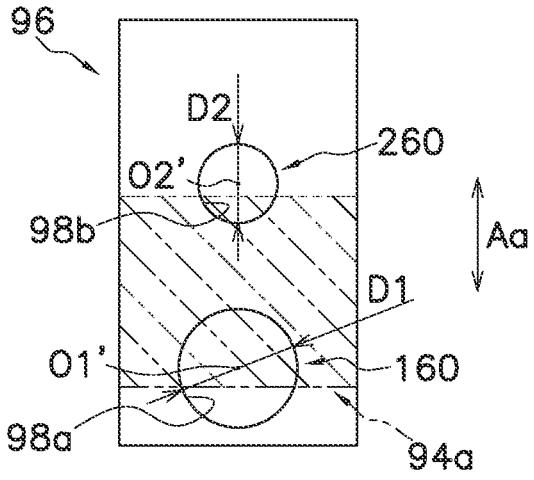
FIG. 9 is a side view of a first hole and a second hole formed in a fixing portion of the lower housing of a scroll compressor according to Modification A as viewed from an outer peripheral surface of the fixing portion toward a center axis of the crankshaft.

However, the scroll compressor 100 of the present disclosure may be configured as shown in FIG. 9. FIG. 9 is a side view of a first hole 98*a* and a second hole 98*b* formed in a fixing portion 96 of a lower housing 130 of a scroll compressor 100 according to Modification A as viewed from an outer peripheral surface 96*f* of the fixing portion 96 toward a center axis C of the crankshaft 80.

In FIG. 9, when the first hole 98*a* is viewed along the radial direction Ar of the crankshaft 80 orthogonal to the axial direction Aa of the crankshaft 80 toward the center axis C of the crankshaft 80, a center O1' of the first hole 98*a* is disposed at a position overlapping the minimum sectional area portion 94*a* of the arm 94. However, when the first hole 98*a* is viewed along the radial direction Ar of the crankshaft 80 orthogonal to the axial direction Aa of the crankshaft 80 toward the center axis C of the crankshaft 80, a part of the first hole 98*a* is disposed at a position outside the minimum sectional area portion 94*a* of the arm 94.

In FIG. 9, when the second hole 98*b* is viewed along the radial direction Ar of the crankshaft 80 orthogonal to the axial direction Aa of the crankshaft 80 toward the center axis C of the crankshaft 80, a center O2' of the second hole 98*b* is disposed at a position outside the minimum sectional area portion 94*a* of the arm 94. However, when the second hole 98*b* is viewed along the radial direction Ar of the crankshaft 80 orthogonal to the axial direction Aa of the crankshaft 80 toward the center axis C of the crankshaft 80, a part of the second hole 98*b* is disposed at a position overlapping the minimum sectional area portion 94*a* of the arm 94.

In the first embodiment, one of a configuration in which a part of the first hole 98*a* is disposed at a position outside the minimum sectional area portion 94*a* of the arm 94 or a configuration in which a part of the second hole 98*b* is disposed at a position overlapping the minimum sectional area portion 94*a* of the arm 94 in FIG. 9 may be combined.

At least one of the configuration in which a part of the first hole 98*a* is disposed at a position outside the minimum sectional area portion 94*a* of the arm 94 or the configuration in which a part of the second hole 98*b* is disposed at a position overlapping the minimum sectional area portion 94*a* of the arm 94 in FIG. 9 may be combined with the scroll compressor 100 according to the second embodiment.

(5-2) Modification B

In the fixing portion 96 of the scroll compressor 100 according to the first embodiment, the second hole 98*b* is formed above the first hole 98*a*.

Figure 10:
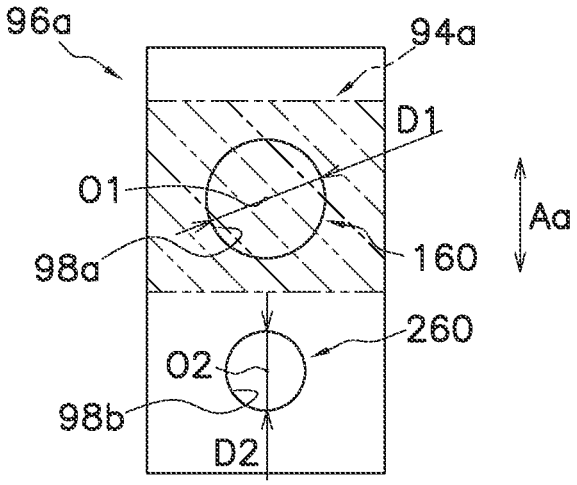
FIG. 10 is a side view of a first hole and a second hole formed in a fixing portion of a lower housing of a scroll compressor according to Modification B as viewed from an outer peripheral surface of the fixing portion toward a center axis of the crankshaft.

However, in the scroll compressor 100 of the present disclosure, the fixing portion 96*a* may be configured as shown in FIG. 10. FIG. 10 is a side view of a first hole 98*a* and a second hole 98*b* formed in a fixing portion 96*a* of a lower housing 130 of a scroll compressor 100 according to Modification B as viewed from an outer peripheral surface 96*f* of the fixing portion 96 toward a center axis C of the crankshaft 80.

In the fixing portion 96*a*, as is obvious from FIG. 10, the second hole 98*b* is formed below the first hole 98*a*. The scroll compressor 100 according to Modification B is similar to the scroll compressor 100 according to the first embodiment in terms of other points.

The arrangement of the first hole and the second hole according to Modification B may be applied to the scroll compressor 100 according to the second embodiment.

(5-3) Modification C

In the scroll compressor 100 according to the first embodiment, one first hole 98*a* and one second hole 98*b* are formed in each fixing portion 96.

Figure 11:
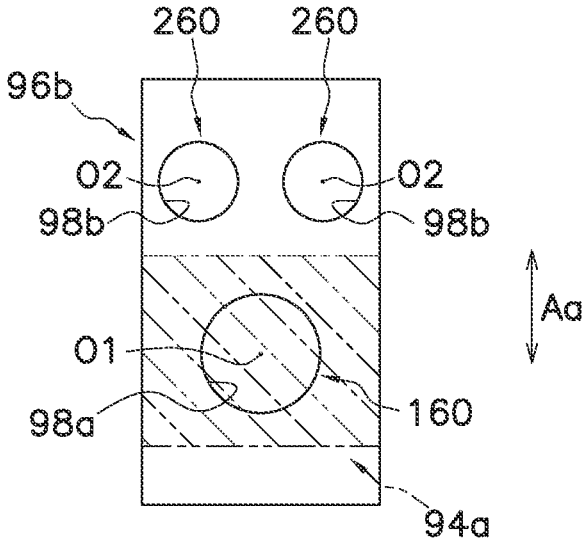
FIG. 11 is a side view of a first hole and a second hole formed in a fixing portion of a lower housing of a scroll compressor according to Modification C as viewed from an outer peripheral surface of the fixing portion toward a center axis of the crankshaft.

However, the present disclosure is not limited to this configuration, and as in a fixing portion 96*b* of a scroll compressor 100 according to Modification C shown in FIG. 11, a plurality of second holes 98*b* may be formed in each fixing portion 96*b*. FIG. 11 is a side view of the first hole 98*a* and the second holes 98*b* formed in the fixing portion 96*b* of the lower housing 130 of the scroll compressor 100 according to Modification C as viewed from an outer peripheral surface of the fixing portion 96*b* toward the center axis C of the crankshaft 80.

Although not shown, a plurality of first holes 98*a* may be formed in each fixing portion 96 of the scroll compressor 100 in the first embodiment.

The configuration in which at least one of the plurality of first holes or the plurality of second holes in Modification C is provided may be applied to the scroll compressor 100 according to the second embodiment.

(5-4) Modification D

In the scroll compressor 100 according to the first embodiment, the first hole 98*a* and the second hole 98*b* are disposed at different positions in the axial direction Aa of the crankshaft 80.

Figure 12:
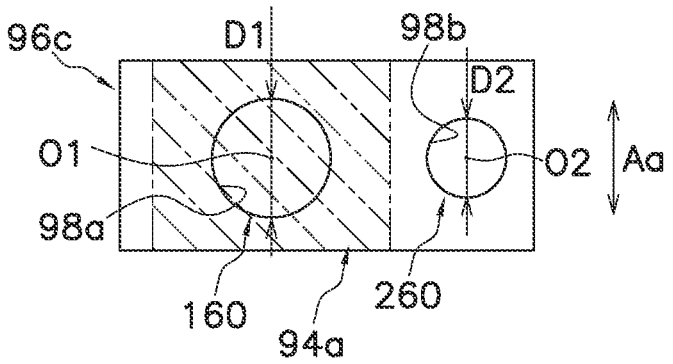
FIG. 12 is a side view of a first hole and a second hole formed in a fixing portion of a lower housing of a scroll compressor according to Modification D as viewed from an outer peripheral surface of the fixing portion toward a center axis of the crankshaft.

However, the present disclosure is not limited to this configuration. In each fixing portion 96*c*, as shown in FIG. 12, the first hole 98*a* and the second hole 98*b* may be disposed at the same position in the axial direction Aa of the crankshaft 80 and at different positions with respect to the center axis C of the crankshaft 80 in a circumferential direction. The recitation that "the first hole 98*a* and the second hole 98*b* are disposed at the same position in the axial direction Aa of the crankshaft 80" specifically means that the center O1 of the first hole 98*a* and the center O2 of the second hole 98*b* are disposed at the same position in the axial direction Aa of the crankshaft 80.

FIG. 12 is a side view of a first hole 98*a* and a second hole 98*b* formed in a fixing portion 96*b* of a lower housing 130 of a scroll compressor 100 according to Modification D as viewed from an outer peripheral surface of the fixing portion 96*b* toward a center axis C of a crankshaft 80.

The configuration in which the first hole and the second hole according to Modification D are disposed at different positions in the circumferential direction of the crankshaft 80 may be applied to the scroll compressor 100 according to the second embodiment.

(5-5) Modification E

In the scroll compressor 100 according to the first embodiment, the first hole 98*a* and the second hole 98*b* are arranged along the axial direction Aa of the crankshaft 80. In other words, in each fixing portion 96, the center O1 of the first hole 98*a* and the center O2 of the second hole 98*b* are disposed at the same position in the circumferential direction of the crankshaft 80. However, the present disclosure is not limited to such an arrangement, and the first hole 98*a* and the second hole 98*b* provided in each fixing portion 96 may be disposed at different positions in the circumferential direction of the crankshaft 80.

The configuration of Modification E may be applied to the scroll compressor 100 according to the second embodiment.

(5-6) Modification F

In the scroll compressor 100 according to the first embodiment, the diameter D1 of the welding pin 160 when the welding pin 160 is viewed along the press-fitting direction is made larger than the diameter D2 of the welding pin 260 when the welding pin 260 is viewed along the press-fitting direction, so that the holding force F1 with which the welding pin 160 is held by the fixing portion 96 is made larger than the holding force F2 with which the welding pin 260 is held by the fixing portion 96. In the scroll compressor 100 according to the second embodiment, the length L1 of the welding pin 160 in the press-fitting direction is made larger than length L2 of the welding pin 260 in the press-fitting direction, so that the holding force F1 with which the welding pin 160 is held by the fixing portion 96 is made larger than the holding force F2 with which the welding pin 260 is held by the fixing portion 96.

However, the method of making the holding force F1 with which the welding pin 160 is held by the fixing portion 96 larger than the holding force F2 with which the welding pin 260 is held by the fixing portion 96 is not limited to such a configuration.

For example, the lengths of the welding pin corresponding to the first pin and the welding pin corresponding to the second pin and the diameters of the welding pin corresponding to the first pin and the welding pin corresponding to the second pin (in other words, diameters of the first hole and the second hole) may be the same. Instead, by making a press-fitting allowance (fastening allowance) of the welding pin corresponding to the first pin for the first hole larger than a press-fitting allowance of the welding pin corresponding to the second pin for the second hole (in other words, by increasing a surface pressure at which the hole of the fixing portion presses the welding pin), the holding force F1 with which the welding pin 160 is held by the fixing portion 96 may be made larger than the holding force F2 with which the welding pin 260 is held by the fixing portion 96.

(5-7) Modification G

In the above embodiments, a vertical scroll compressor in which the axial direction of the crankshaft 80 is a vertical direction is described as an example. Alternatively, the compressor may be a horizontal compressor in which the axial direction of the crankshaft 80 is a horizontal direction.

(5-8) Modification H

In the above embodiment, the housing 50 and the lower housing 130 support the bearing metal 112 and the bearing metal 91 as examples of bearings, respectively, but the present disclosure is not limited to this configuration. For example, the housing 50 and the lower housing 130 may support roller bearings such as ball bearings instead of the bearing metals 112 and 91.

(5-9) Modification I

In the first and second embodiments, the scroll compressor of the present disclosure is described by taking, as an example, a case where the welding pins 160 and 260 have irregularities on the outer peripheral surface (α shape in which the grooves 162 are formed on the outer peripheral surface). Alternatively, the welding pins 160 and 260 used in the scroll compressor of the present disclosure before press-fitting may be cylindrical welding pins having no irregularities on the outer peripheral surface of the welding pins and having a diameter larger than a diameter of a hole to be press-fitted.

Notes

The embodiments of the present disclosure have been described above. It will be understood that various changes to modes and details can be made without departing from the gist and scope of the present disclosure recited in the claims.

The present disclosure is widely applicable to a scroll compressor and is useful.

The invention claimed is:

1. A scroll compressor comprising:

a crankshaft;

a bearing that rotatably supports the crankshaft;

a casing that accommodates the crankshaft and the bearing;

an arm that supports the bearing and extends from the bearing toward the casing in a direction intersecting an axial direction of the crankshaft;

a fixing portion connected to an end of the arm and fixed to the casing;

a first pin press-fitted into a first hole and fixed to the casing by welding, the first hole being formed in the fixing portion and having a first center disposed at a position overlapping a minimum sectional area portion of the arm when viewed along a first direction orthogonal to the axial direction of the crankshaft toward a center axis of the crankshaft; and a second pin press-fitted into a second hole and fixed to the casing by welding, the second hole being formed in the fixing portion and having a second center disposed at a position outside the minimum sectional area portion of the arm when viewed along a second direction orthogonal to the axial direction of the crankshaft toward the center axis of the crankshaft, a first force with which the first pin is held by the fixing portion being larger than a second force with which the second pin is held by the fixing portion.

2. The scroll compressor according to claim 1, wherein the first hole and the second hole are disposed at different positions in the axial direction of the crankshaft.

3. The scroll compressor according to claim 2, wherein a first diameter of the first pin when the first pin is viewed along a press-fitting direction is larger than a second diameter of the second pin when the second pin is viewed along a press-fitting direction.

4. The scroll compressor according to claim 3, wherein the first diameter of the first pin when the first pin is viewed along the press-fitting direction is 1.5 times to 2.5 times the second diameter of the second pin when the second pin is viewed along the press-fitting direction.

5. The scroll compressor according to claim 2, wherein a first length of the first pin in a press-fitting direction of the first pin is longer than a second length of the second pin in a press-fitting direction of the second pin.

6. The scroll compressor according to claim 5, wherein the first length of the first pin in the press-fitting direction of the first pin is 1.5 to 2.5 times the second length of the second pin in the press-fitting direction of the second pin.

7. A refrigeration cycle apparatus including the scroll compressor according to claim 2, the refrigeration cycle apparatus further comprising:

a condenser;

an evaporator; and an expansion device, the scroll compressor, the condenser, the evaporator and the expansion device forming parts of a refrigerant circuit.

8. The scroll compressor according to claim 1, wherein a first diameter of the first pin when the first pin is viewed along a press-fitting direction is larger than a second diameter of the second pin when the second pin is viewed along a press-fitting direction.

9. The scroll compressor according to claim 8, wherein the first diameter of the first pin when the first pin is viewed along the press-fitting direction is 1.5 times to 2.5 times the second diameter of the second pin when the second pin is viewed along the press-fitting direction.

10. The scroll compressor according to claim 8, wherein a first length of the first pin in a press-fitting direction of the first pin is longer than a second length of the second pin in a press-fitting direction of the second pin.

11. The scroll compressor according to claim 10, wherein the first length of the first pin in the press-fitting direction of the first pin is 1.5 to 2.5 times the second length of the second pin in the press-fitting direction of the second pin.

12. A refrigeration cycle apparatus including the scroll compressor according to claim 8, the refrigeration cycle apparatus further comprising:

a condenser;

an evaporator; and an expansion device, the scroll compressor, the condenser, the evaporator and the expansion device forming parts of a refrigerant circuit.

13. The scroll compressor according to claim 1, wherein a first length of the first pin in a press-fitting direction of the first pin is longer than a second length of the second pin in a press-fitting direction of the second pin.

14. The scroll compressor according to claim 13, wherein the first length of the first pin in the press-fitting direction of the first pin is 1.5 to 2.5 times the second length of the second pin in the press-fitting direction of the second pin.

15. A refrigeration cycle apparatus including the scroll compressor according to claim 13, the refrigeration cycle apparatus further comprising:

a condenser;

an evaporator; and an expansion device, the scroll compressor, the condenser, the evaporator and the expansion device forming parts of a refrigerant circuit.

16. A refrigeration cycle apparatus including the scroll compressor according to claim 1, the refrigeration cycle apparatus further comprising:

a condenser;

an evaporator; and an expansion device, the scroll compressor, the condenser, the evaporator and the expansion device forming parts of a refrigerant circuit.

* * * * *